US008079195B2

(12) United States Patent
Cables

(10) Patent No.: US 8,079,195 B2
(45) Date of Patent: Dec. 20, 2011

(54) MODULAR BLOCKS AND STRUCTURES MADE THEREFROM

(76) Inventor: Raymond Walter Cables, Fort Mill, SC (US)

( * ) Notice: Subject to any disclaimer, the term of this patent is extended or adjusted under 35 U.S.C. 154(b) by 998 days.

(21) Appl. No.: 11/817,289

(22) PCT Filed: Nov. 11, 2005

(86) PCT No.: PCT/US2005/040709

§ 371 (c)(1),
(2), (4) Date: Aug. 28, 2007

(87) PCT Pub. No.: WO2006/093540

PCT Pub. Date: Sep. 8, 2006

(65) Prior Publication Data

US 2008/0263986 A1 Oct. 30, 2008

Related U.S. Application Data

(60) Provisional application No. 60/657,226, filed on Feb. 28, 2005.

(51) Int. Cl.
*E04B 1/02* (2006.01)

(52) U.S. Cl. ..... 52/572; 52/561; 52/604; 52/589.1

(58) Field of Classification Search ..... 52/561, 52/562, 563, 564, 568, 569, 570, 571, 572, 52/582.1, 587.1, 586.1, 586.2, 585.1, 604, 52/589.1, 890.2, 590.3, 591.1, 591.2, 591.3, 52/591.4, 591.5; 446/124, 125
See application file for complete search history.

(56) References Cited

U.S. PATENT DOCUMENTS

| | | | | |
|---|---|---|---|---|
| 1,952,175 | A * | 3/1934 | Liptak | 52/562 |
| 1,957,820 | A * | 5/1934 | Crysler | 52/506.04 |
| 2,392,551 | A * | 1/1946 | Roe | 52/586.2 |
| 2,732,706 | A * | 1/1956 | Friedman | 52/586.1 |
| 5,457,926 | A * | 10/1995 | Jensen | 52/604 |
| 5,899,040 | A * | 5/1999 | Cerrato | 52/604 |
| 5,901,520 | A * | 5/1999 | Abdul-Baki | 52/592.6 |
| 6,010,279 | A * | 1/2000 | Taylor-Smith | 405/286 |
| 6,115,983 | A * | 9/2000 | Poignard | 52/606 |
| 6,189,282 | B1 * | 2/2001 | VanderWerf | 52/582.1 |
| 6,474,036 | B2 * | 11/2002 | Martin et al. | 52/604 |
| 6,892,501 | B2 * | 5/2005 | Davis | 52/586.2 |
| 2002/0001509 | A1 * | 1/2002 | Hong | 405/286 |

* cited by examiner

*Primary Examiner* — Jessica Laux
(74) *Attorney, Agent, or Firm* — Shumaker, Loop & Kendrick, LLP

(57) ABSTRACT

A modular block apparatus includes first and second blocks, each block having a generally upwardly protruding locking member and an internal recess sized to receive the locking member of the other block, such that the blocks can be assembled with one block above the other. The blocks are secured together in a vertical direction by relative lateral movement of the locking member and the internal recess. A locking device is provided to prevent relative lateral movement of the locking member and the internal recess so as to retain the blocks in a connected condition. The locking member may be an integral hook, a separate hook, or a cylindrical locking rod. If a hook is used, its orientation relative to the block may be varied. A variety of structures may be built up from the modular blocks.

4 Claims, 41 Drawing Sheets

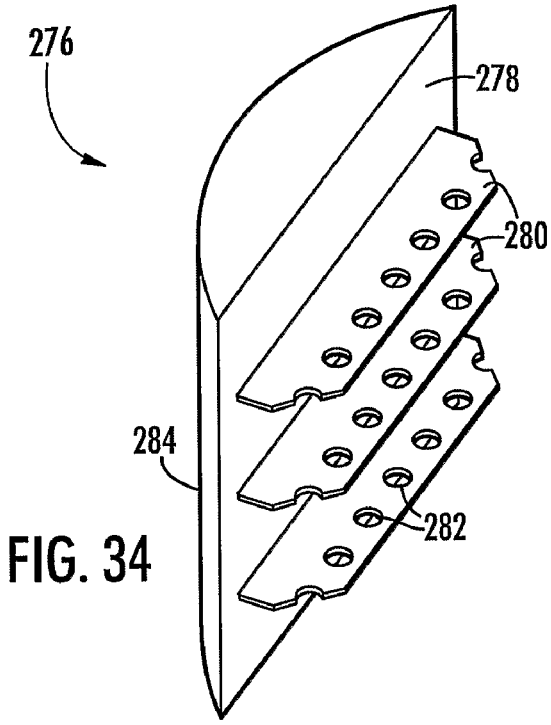
FIG. 34
FIG. 35
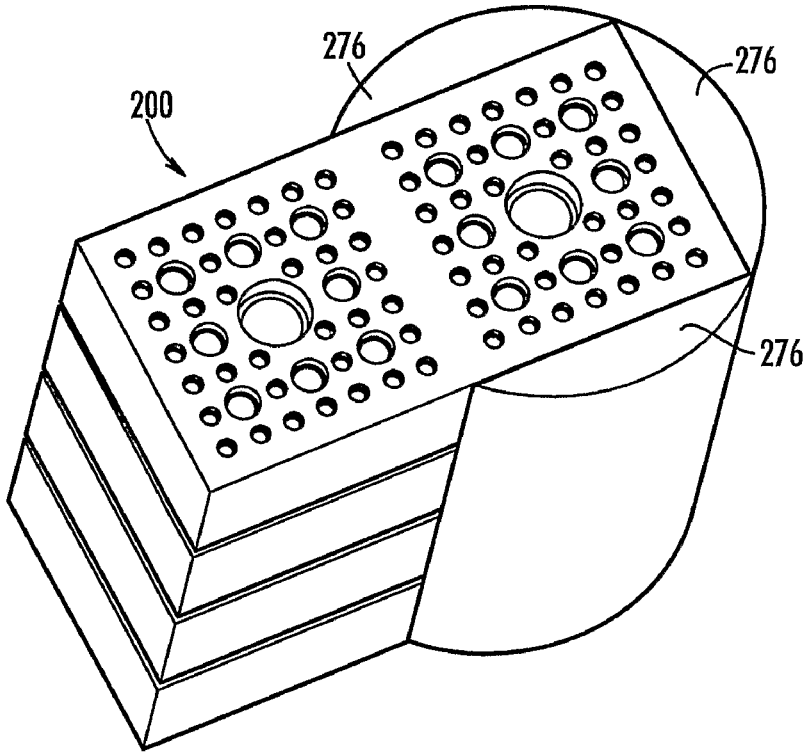

MODULAR BLOCKS AND STRUCTURES MADE THEREFROM

BACKGROUND OF THE INVENTION

This invention relates generally to modular construction systems and more particularly to a system of modular blocks which can be connected in various ways.

Various construction systems exist in which identical or similar modular elements are built up into larger structures. Known examples of modular building elements include bricks and concrete blocks. While these provide a modular configuration, they lack a self-connecting feature and must be assembled with separate fasteners, adhesives, or mortar.

Systems of interlocking construction blocks are also known. These are typically used for toys or small-scale models, and typically rely on friction or snap-type connectors. While these systems provide a self-connecting feature, the user is limited to preformed blocks which have fixed connector elements.

Accordingly, there is a need for a modular construction element having a connector that can be configured in different ways.

BRIEF SUMMARY OF THE INVENTION

Therefore, it is an object of the invention to provide a block that can be used to build up modular structures.

It is another object of the invention to provide a modular block with a connector that can be oriented in different directions.

These and other objects are achieved by the present invention, which in one embodiment provides a modular block apparatus, including: first and second blocks, each block having a generally upwardly protruding locking member and an internal recess sized to receive the locking member of the other block such that the blocks can be assembled with one block above the other. The blocks are secured together in a vertical direction by relative lateral movement of the locking member and the internal recess. Means are provided for preventing relative lateral movement of the locking member and the internal recess so as to retain the blocks in a connected condition.

According to another embodiment of the invention, a modular block apparatus includes: a block with top and bottom surfaces, a front sidewall, and an interior cavity formed therein, the interior cavity defining a locking recess communicating with the bottom surface, and a lug receptacle communication with the top surface; and a locking lug received in the lug receptacle, the locking lug having a laterally-extending hook protruding above the top surface.

According to another embodiment of the invention, the lug receptacle includes at least one protruding side boss disposed therein; and the locking lug includes at least one lug boss disposed thereon. The lug bosses and the side bosses are arranged such that the hook faces in a selected one of a plurality of directions relative to the front sidewall, and the lug is retained, by engagement of the bosses, against withdrawal from the lug receptacle in a vertical direction.

According to another embodiment of the invention, the interior cavity includes a generally vertical portion extending between the lug receptacle and the locking recess.

According to another embodiment of the invention, the modular block apparatus further includes a key disposed in the vertical portion which prevents lateral motion of the locking lug.

According to another embodiment of the invention, the key prevents lateral motion of a hook received in the locking recess.

According to another embodiment of the invention, the block has at least one generally vertical edge, and includes: at least one open corner slot formed in the vertical edge; and a generally vertically-extending corner hole disposed near the vertical edges and intersecting the corner slot.

According to another embodiment of the invention, the modular block further includes: a connector plate having a thickness sized to fit in the corner slot, and a connector pin hole formed therethrough; and a connector pin sized to fit into the corner hole and the connector pin hole to retain the connector plate in the corner slot.

According to another embodiment of the invention, the connector plate further includes additional connector pin holes formed therethrough and is sized for engaging corner slots of at least two adjacent blocks.

According to another embodiment of the invention, the modular block apparatus further includes a finish element having: a exterior surface having a desired shape; and a laterally-extending connector plate having a thickness sized to fit in the corner slot, and a connector pin hole formed therethrough.

According to another embodiment of the invention, the hook is substantially smaller than the locking recess.

According to another embodiment of the invention, the block includes a plurality of laterally-extending hooks protruding above the top surface, and each of the hooks is substantially smaller than the locking recess.

According to another embodiment of the invention, the hook is substantially larger than the locking recess.

According to another embodiment of the invention, the block includes a plurality of laterally-extending hooks protruding above the top surface, and each of the hooks is substantially smaller than the locking recess.

According to another embodiment of the invention, a modular block apparatus includes: a block with top and bottom surfaces, and at least one generally cylindrical core passage extending between the top and bottom surfaces; and a locking assembly received in the core passage, the locking assembly including: a core sized to be received in the core passage and having a through-bore extending therethrough, the through-bore defining alternating core grooves and lands; a locking rod having an array of alternating rod grooves and lands complementary to the core grooves and lands; and means for retaining the locking rod in engagement with the core with the locking rod protruding from the top surface.

According to another embodiment of the invention, the retaining means comprise a rod key received in the through-bore and urges the locking rod laterally against the core grooves and lands.

According to another embodiment of the invention, the core passage includes at least one key slot extending laterally therefrom, the key slot being in communication with the bottom surface; and the core carries at least one core key which is moveable between a retracted position and a laterally-extended position. Engagement of the locking means causes the core key to move to the laterally-extended position, where the core key engages the core key slot to prevent withdrawal of the core assembly from the core passage.

According to another embodiment of the invention, the modular block apparatus further includes: a connector plate having a thickness sized to fit in the connector slot, and a connector pin hole formed therethrough; and a connector pin sized to fit into the core passage and the connector pin hole to retain the connector plate in the connector slot.

According to another embodiment of the invention, the connector plate has a generally cylindrical stud protruding therefrom, the stud including a land sized and shaped to engage the core grooves and lands.

According to another embodiment of the invention, the block includes a plurality of core passages of different diameters formed therein.

According to another embodiment of the invention, the block is a generally rectangular solid.

According to another embodiment of the invention, the block is curved.

According to another embodiment of the invention, the block is trapezoidal.

According to another embodiment of the invention, the block includes a pair of lobes connected by a relatively narrow waist.

According to another embodiment of the invention, a modular block apparatus includes: a block with top and bottom surfaces, a front sidewall, and an interior space formed therein. The block includes; first and second spaced-apart side members each having an inner surface and an outer surface; and at least one locking lug disposed between the side members, the locking lug having upper and lower notches formed near each its upper and lower ends, respectively, so as to define upper and lower laterally-extending hooks, wherein the upper hook protrudes from the top surface, and is sized and shaped to engage a lower notch of a second block.

According to another embodiment of the invention, the hook extends towards the front sidewall.

According to another embodiment of the invention, the hook extends generally perpendicular to the front sidewall.

According to another embodiment of the invention, the side members and the locking lug are a single integral component.

According to another embodiment of the invention, the modular block apparatus further includes at least one generally vertical key groove formed in the side members.

According to another embodiment of the invention, the modular block apparatus further includes a key received in the interior space and having an alignment rail which engages the key groove, the key extending between upper and lower positioned blocks to prevent relative lateral movement thereof.

According to another embodiment of the invention, the key includes at least two spaced-apart alignment rails which are adapted to engage respectively key grooves of two laterally-adjacent blocks to prevent separation thereof.

BRIEF DESCRIPTION OF THE DRAWINGS

The invention may be best understood by reference to the following description taken in conjunction with the accompanying drawing figures in which:

FIG. 34 is a perspective view of another finish element;

FIG. 35 is a perspective view of a modular block with a plurality of finish elements connected thereto;

DETAILED DESCRIPTION OF THE INVENTION

Figure 1:
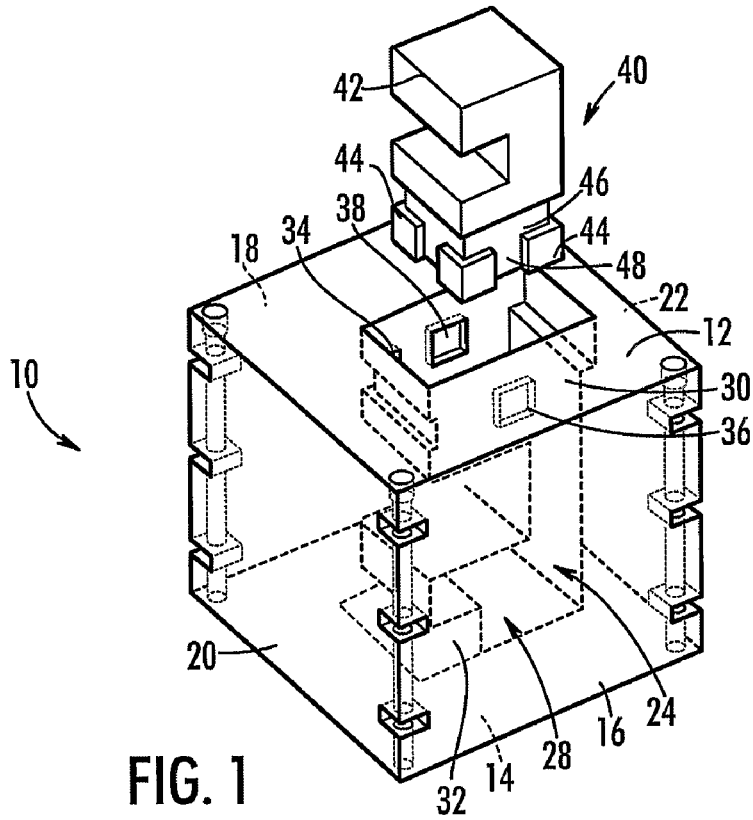
FIG. 1 is a perspective view of a modular block constructed in accordance with the present invention.

Referring to the drawings wherein identical reference numerals denote the same elements throughout the various views, FIG. 1 illustrates an exemplary modular block 10 constructed according to the present invention. The modular block 10 includes a top surface 12, a bottom surface 14, and front, rear, left and right sidewalls 16, 18, 20, and 22, respectively. An interior cavity 24 is formed in approximately the center of the modular block 10. The interior cavity 24 includes a generally vertical portion 26 which extends between a locking recess 28 adjacent the bottom surface 14 of the modular block 10, and a lug receptacle 30 adjacent the top surface 12 of the modular block 10. A ledge 32 extends laterally partway into to the locking recess 28. The lug receptacle 30 is a parallel-sided opening having an end boss 34 extending across an end wall thereof at a selected distance from the top surface 12, and a pair of spaced-apart side bosses 36 and 38 disposed on opposite side walls thereof.

A four-faced locking lug 40 includes an inverted "L"-shaped hook 42 which is sized and shaped to engage the locking recess 28 disposed at its upper end. A lug boss 44 is disposed at each of the lower corners of the locking lug 40. The lug bosses 44 are disposed in a pattern so that they define a lateral slot 46 around the periphery of the locking lug 40, which communicates with a vertical slot 48 on each of the faces of the locking lug 40.

As can be seen in FIG. 1, the locking lug 40 is assembled to the modular block 10 by first inserting it into the lug receptacle 30 in a downwards direction. The side bosses 36 and 38 pass into opposed ones of the vertical slots 48. Once the lug bosses 44 have cleared the side bosses 36 and 38 and the end boss 34 in a vertical direction, the locking lug 40 is then shifted laterally so that two of the lug bosses 44 are aligned with the end boss 34, and two of the lug bosses 44 are aligned with the side bosses 36 and 38. In this position, the locking lug 40 is prevented from being withdrawn vertically from the lug receptacle 30.

The dimensions, material, and surface finish of the locking lug 40 may be selected to provide the desired interface with the lug receptacle 30. For example, if an easily-disassembled joint is desired, a small clearance may be provided between the exterior of the locking lug 40 and the lug receptacle 30. If a more permanent joint is desired, the locking lug 40 may be provided with a tighter fit in the lug receptacle 30, for example by providing a slight interference fit, or by providing a relatively rough surface finish.

Figure 2:
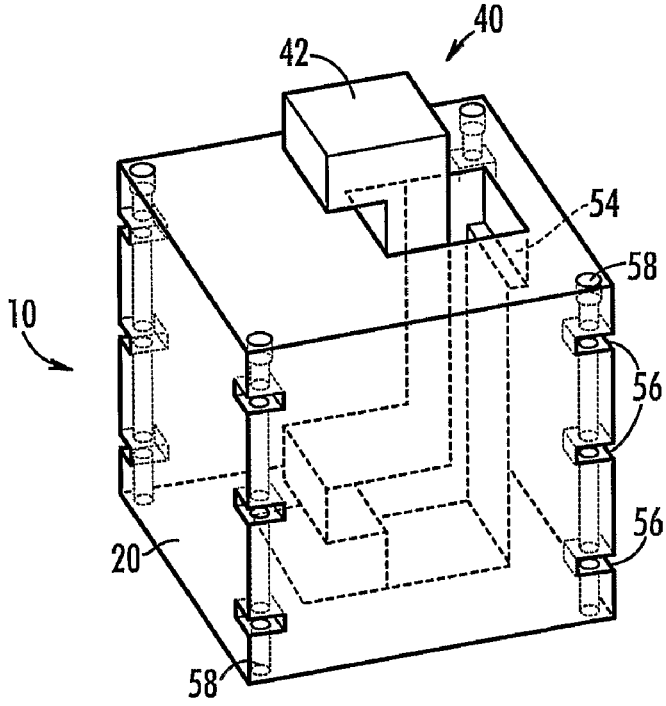
FIG. 2 is a another perspective view of the modular block of FIG. 1.

FIG. 2 illustrates the modular block 10 with the locking lug 40 assembled thereto. In the illustrated example the hook 42 of the locking lug 40 extends towards the left sidewall 20 of the modular block 10. However, it will be appreciated that the locking lug 40 may be assembled to the modular block 10 so that it points in any one of four directions.

The modular block 10 and the locking lug 40 may be constructed of any material which is suited to the application for which the modular block 10 is to be used and which can be formed into the necessary dimensional features. For example, the modular block 10 may be used as a toy, a modeling element, or a light structural element, in which case it may be molded from a material such as plastic resin. The modular block 10 may also be used for heavier structural applications, in which case it may be formed from materials such as concrete, wood or engineered wood materials, pressed fiber, metals, or fiber composite materials. Specific applications of the modular blocks 10 are discussed in more detail below.

Figures 3A, 3B, 3C, 3D:
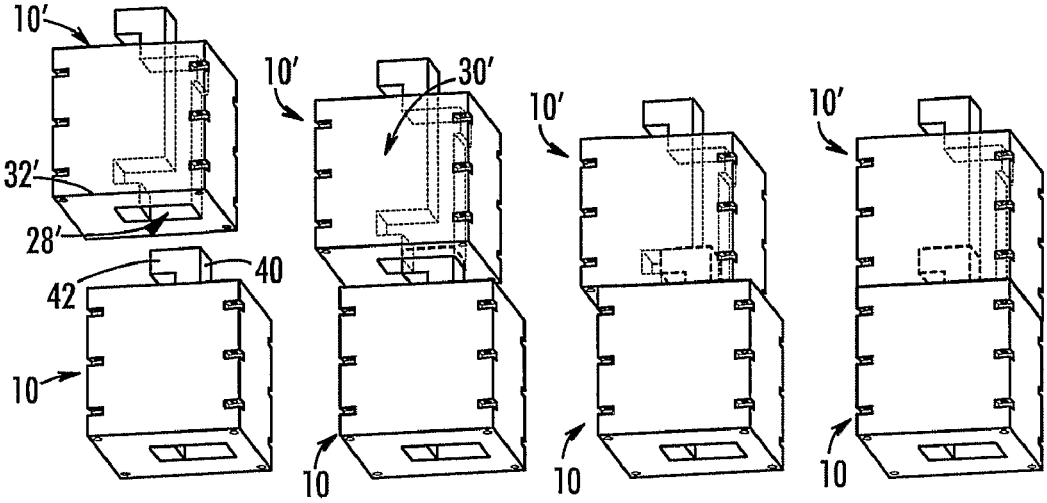
FIG. 3A is a perspective view of a pair of modular blocks constructed in accordance with the present invention in position to be connected.
FIG. 3B is a perspective view of the modular blocks of FIG. 3A in a partially contacting position.
FIG. 3C is a perspective view of the modular blocks of FIG. 3B in a fully contacting position.
FIG. 3D is a perspective view of the modular blocks of FIG. 3C in a fully engaged position.

FIGS. 3A-3G illustrates the two identical modular blocks 10 and 10' to form a larger structure. Modular block 10 is provided with a locking lug 40 having a hook 42 as described above. As shown in FIGS. 3B, 3C and 3D, the hook 42 is inserted into the locking recess 28' of the block 10' and then shifted laterally so that the hook 42 is disposed behind the ledge 32' of the locking recess 28'. This prevents the modular blocks 10 and 10' from being disconnected in a vertical direction.

Figures 3E, 3F, 3G:
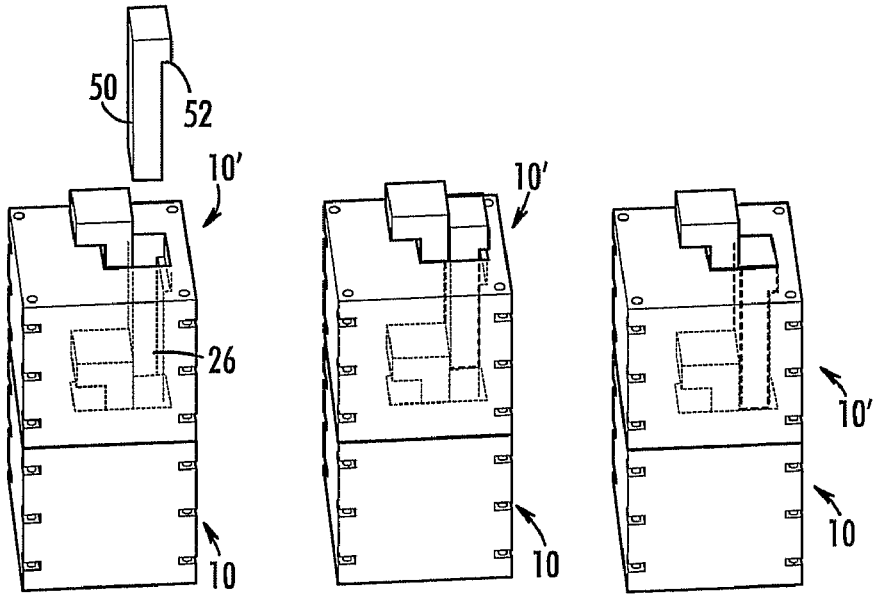
FIG. 3E is a perspective view of the modular blocks of FIG. 3D, along with a locking key about to be inserted therein.
FIG. 3F is a perspective view of the modular blocks of FIG. 3E, with a locking key partially inserted therein.
FIG. 3G is a perspective view of the modular blocks of FIG. 3F, with a locking key fully inserted therein.

To secure the blocks together, a key 50 is inserted into the vertical portion 26' (see FIGS. 3E and 3F). The key 50 is an elongated member sized to fit into the vertical portion 26' of the cavity 24' (identical to cavity 24). As shown in FIG. 3G, the presence of the key 50 prevents lateral motion of the hook 42 relative to the locking recess 28'. The key 50 may be provided with a cut-back edge 52 that engages a shelf 54 of the lug receptacle (best seen in the identical block 10 of FIG. 2), to prevent the key 50 from falling out of the bottom of the modular blocks 10 and 10'. As noted above with respect to the locking lug 40, the dimensions, materials, and surface finish of the key 50 may be selected to prevent unintended withdrawal.

Figure 4A:
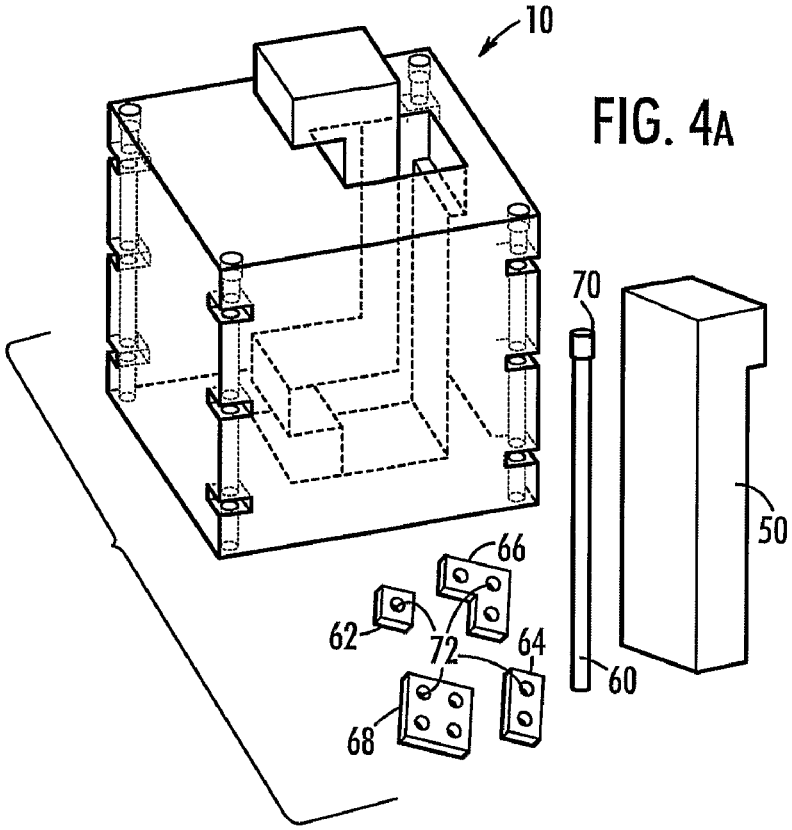
FIG. 4A is a perspective view of a modular block along with a connector plate and connector pin.

As shown in FIG. 2, the modular block 10 includes an array of laterally-extending corner slots 56 formed in each of its vertical edges. A corner hole 58 passes through the modular block 10 near each of its vertical edges and thus intersects the corner slots 56 formed along each vertical edge. FIG. 4A illustrates components used to connect two or more modular blocks 10 together laterally, including a connector pin 60, and various connector plates 62, 64, 66, and 68. The connector pin 60 is an elongated pin sized to fit the corner hole 58. It may include an enlarged head 70 to prevent it from falling through the modular block 10. Each connector plate is a flat member having a thickness sized to fit in one of the corner slots 56 of a modular block 10, and one or more connector pin holes 72. In the illustrated example, the connector plate 62 has a single hole and is sized to fill in a corner slot 56 but not to perform any joining function. The connector plate 64 is rectangular and has two connector pin holes 72 therein. The connector plate 66 is "L"-shaped and has three connector pin holes 72. Finally, the connector plate 68 is square and has four connector pin holes 72 therein.

Figure 4B:
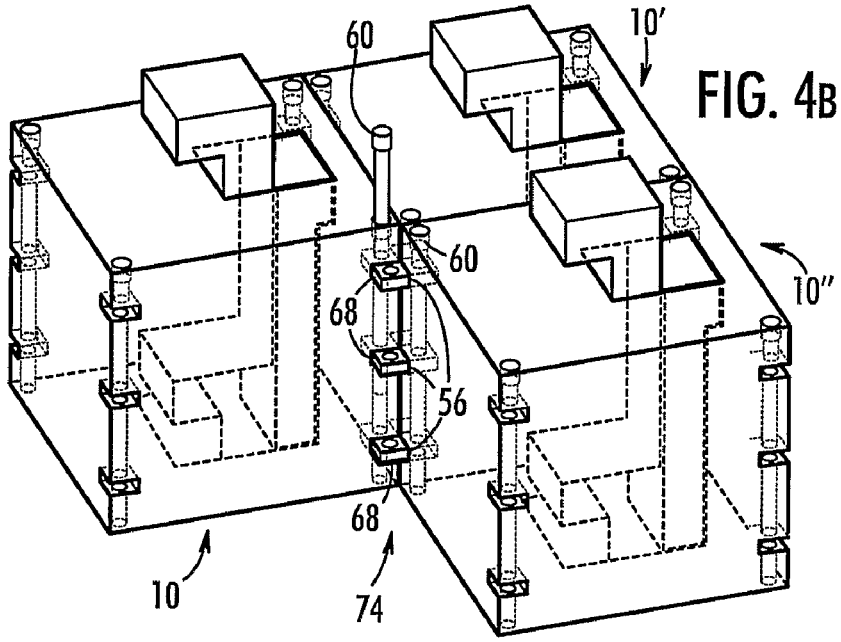
FIG. 4B is a perspective of a plurality of modular blocks connected with connector plates and pins.

FIG. 4B illustrates several modular blocks 10, 10' and 10" connected together. The modular blocks 10, 10' and 10" meet at a common vertical edge 74, and connector plates 68 are inserted into corner slots 56 of each of the modular blocks 10, 10', and 10". A connector pin 60 is then inserted into the corner holes 58 of each of the modular blocks 10, 10', and 10". This secures each of the modular blocks 10, 10', and 10" to the connector plates 68 and thus secures the modular blocks 10, 10', and 10" to each other, in both lateral and vertical directions.

Figure 5A:
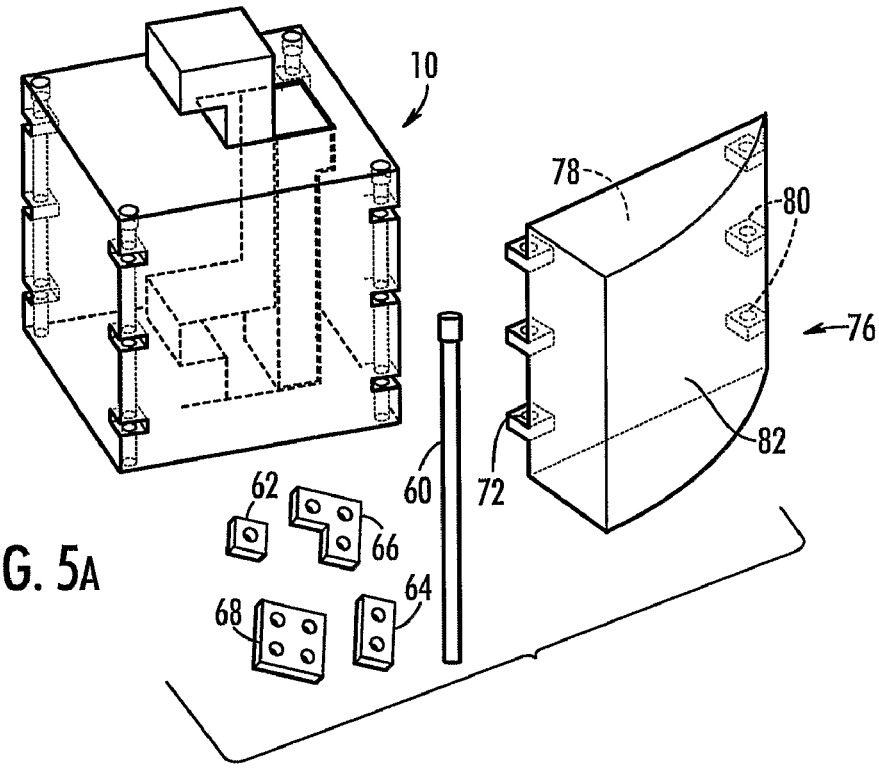
FIG. 5A is a perspective view of a modular block along with a connector plate, connector pin, and a finish element.

FIG. 5A illustrates a modular block 10 along with a connector pin 60, connector plates 62-68, and a finish element 76. The finish element 76 has a planar inner side 78 which is sized and shaped to mate with a side wall of the modular block 10. The inner side 78 includes one or more connector tabs 80 with connector pin holes 72 therein. The connector tabs 80 are positioned and sized to fit into corner slots 56 of the modular block 10. The finish element 76 has an exterior surface 82 with one or more sides or facets which are formed into a desired shape. In the illustrated example, the exterior surface of the finish element 76 is shaped to form a portion of a cylinder.

Figure 5B:
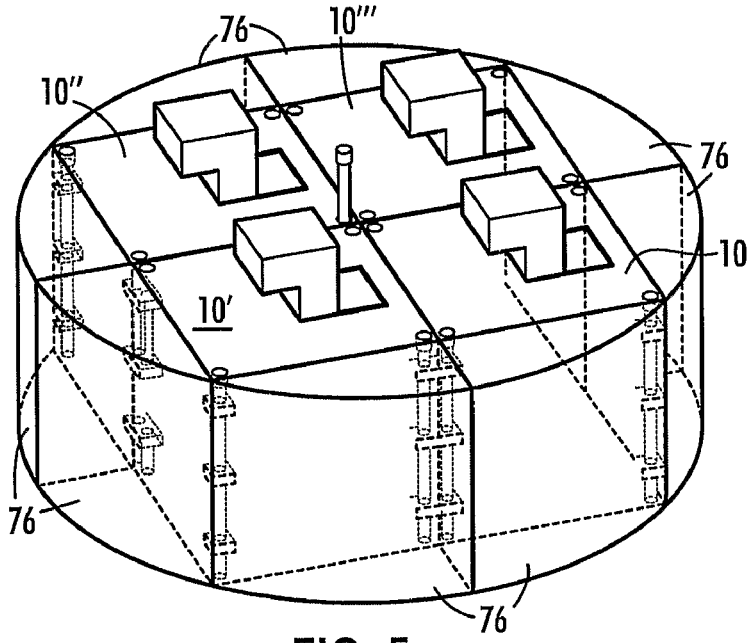
FIG. 5B is a perspective view of a plurality of modular blocks connected with connector plates and pins, and having finish elements attached thereto.

FIG. 5B illustrates several modular blocks 10, 10', 10", and 10'" connected together with several finish elements 76, using the connector plates 68, connector tabs 80, and connector pins 60 as described above to form a solid structure with a cylindrical outer surface. As can be observed from FIG. 5B, the use of finish elements 76 allows the creation of structures that are essentially modular, but which have arbitrary external shapes.

Figure 6:
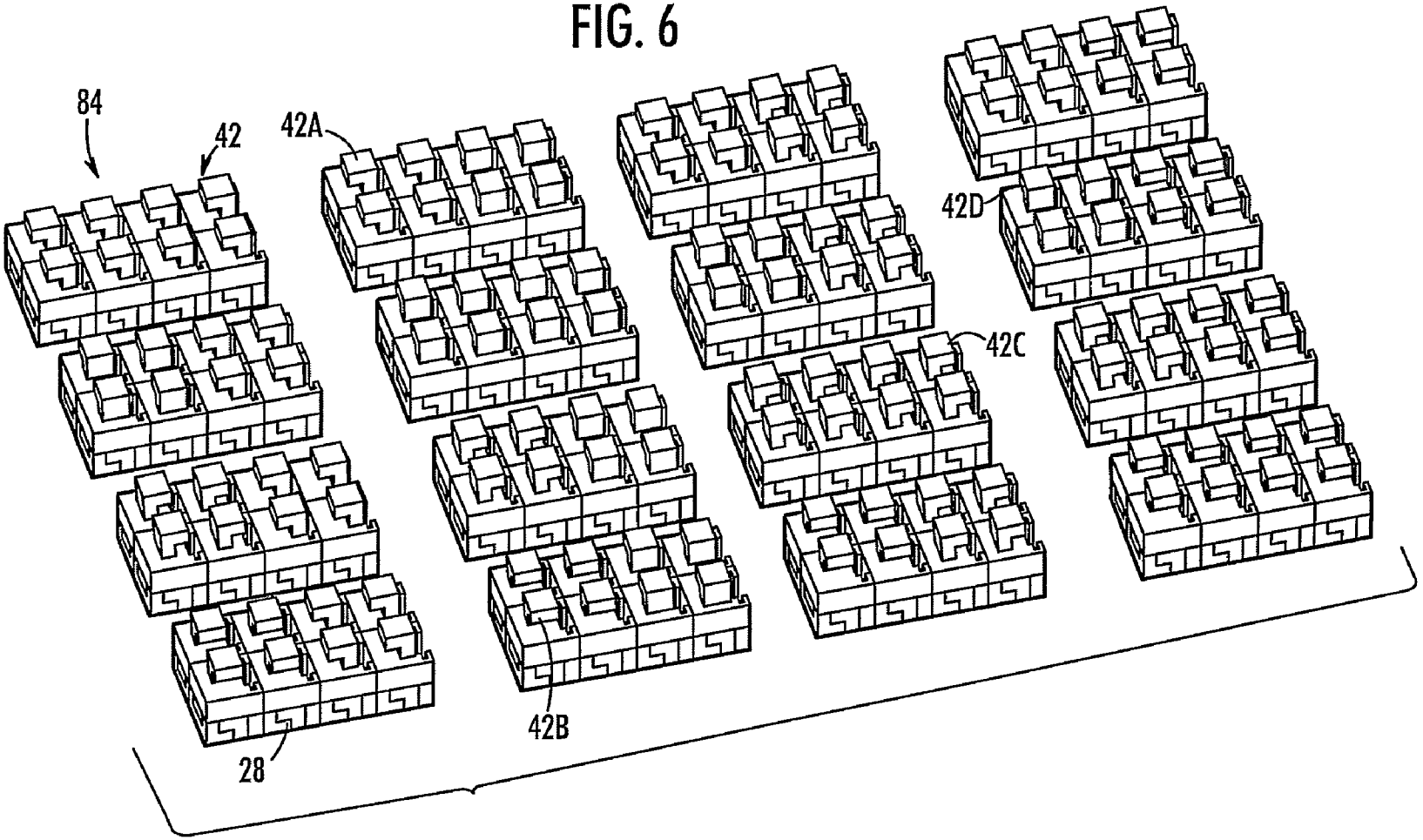
FIG. 6 is a perspective view of a plurality of modular blocks having locking elements oriented in varied directions.
Figure 7:
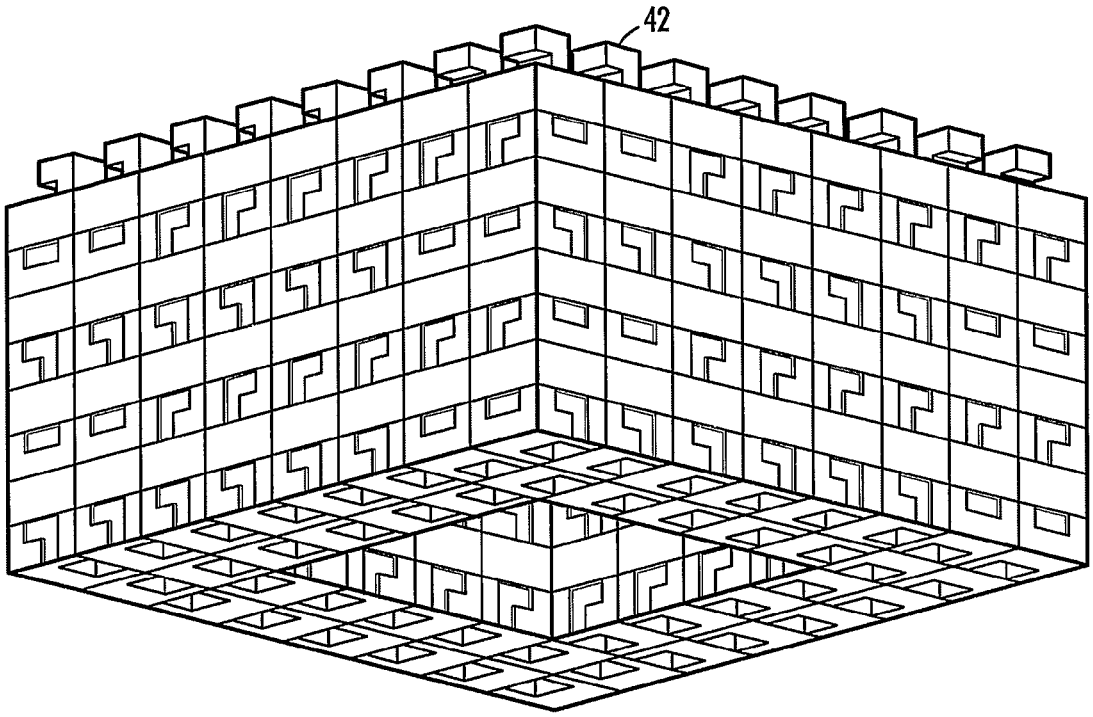
FIG. 7 is a perspective view of a structure built-up from a plurality of modular blocks having locking elements oriented in varied directions.
Figure 8:
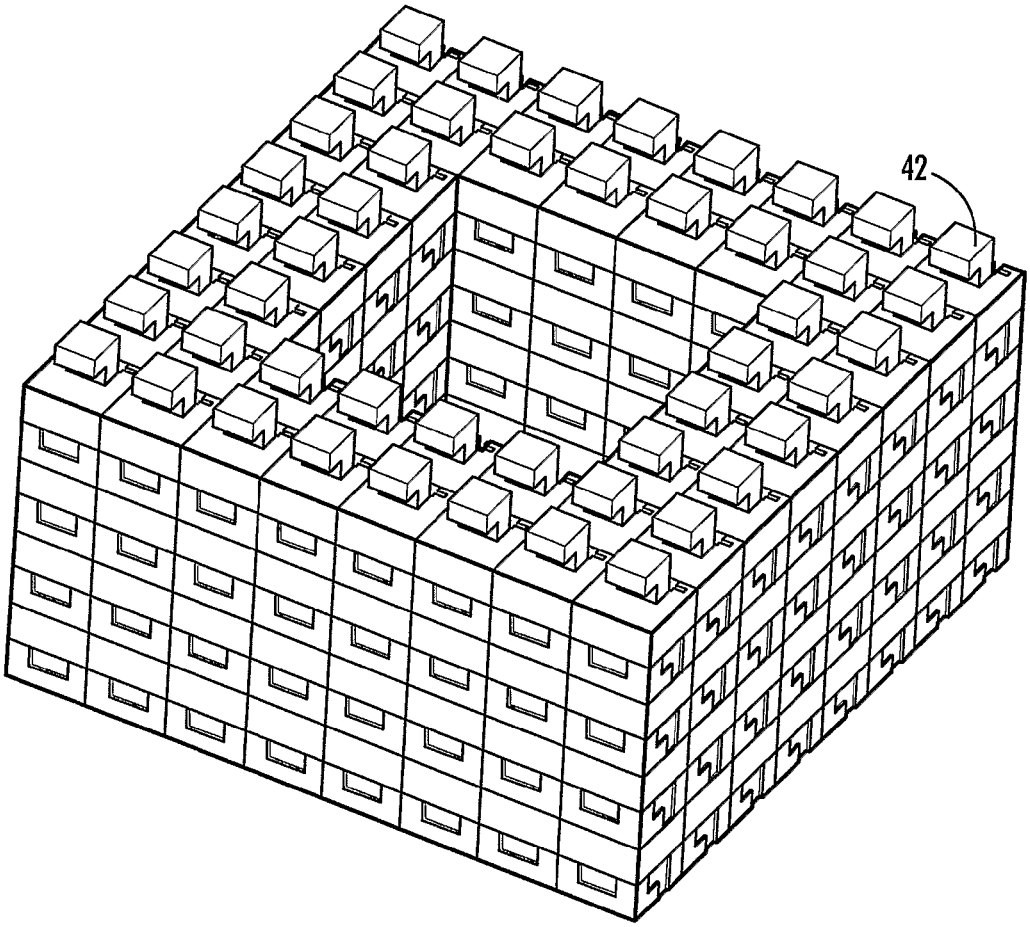
FIG. 8 is a perspective view of a structure built-up from a plurality of modular blocks having locking elements oriented in the same direction.

FIG. 6 illustrates a plurality of building elements 84. Each of these building elements 84 has multiple "L"-shaped hooks 42 extending from an upper surface thereof, and multiple locking recesses 26 on a lower surface thereof. The building elements 84 can be made as a single element, or built up from individual modular blocks 10. The direction that each hook 42 faces can be arbitrarily selected to suit a particular application. In FIG. 6, each hook labeled 42A is facing towards the left of the page, each hook labeled 42B is facing towards the bottom of the page, each hook labeled 42C is facing towards the right of the page, and each hook labeled 42D is facing towards the top of the page. If the eight hooks 42 on each building element 84 are divided into groups of four, there are then 16 possible combinations of hook directions. FIG. 7 illustrates a structure which is built up from building elements 84 having hooks 42 facing in different directions, while FIG. 8 illustrates a structure which is built up from building elements having hooks 42 all facing in a single direction.

Figure 9:
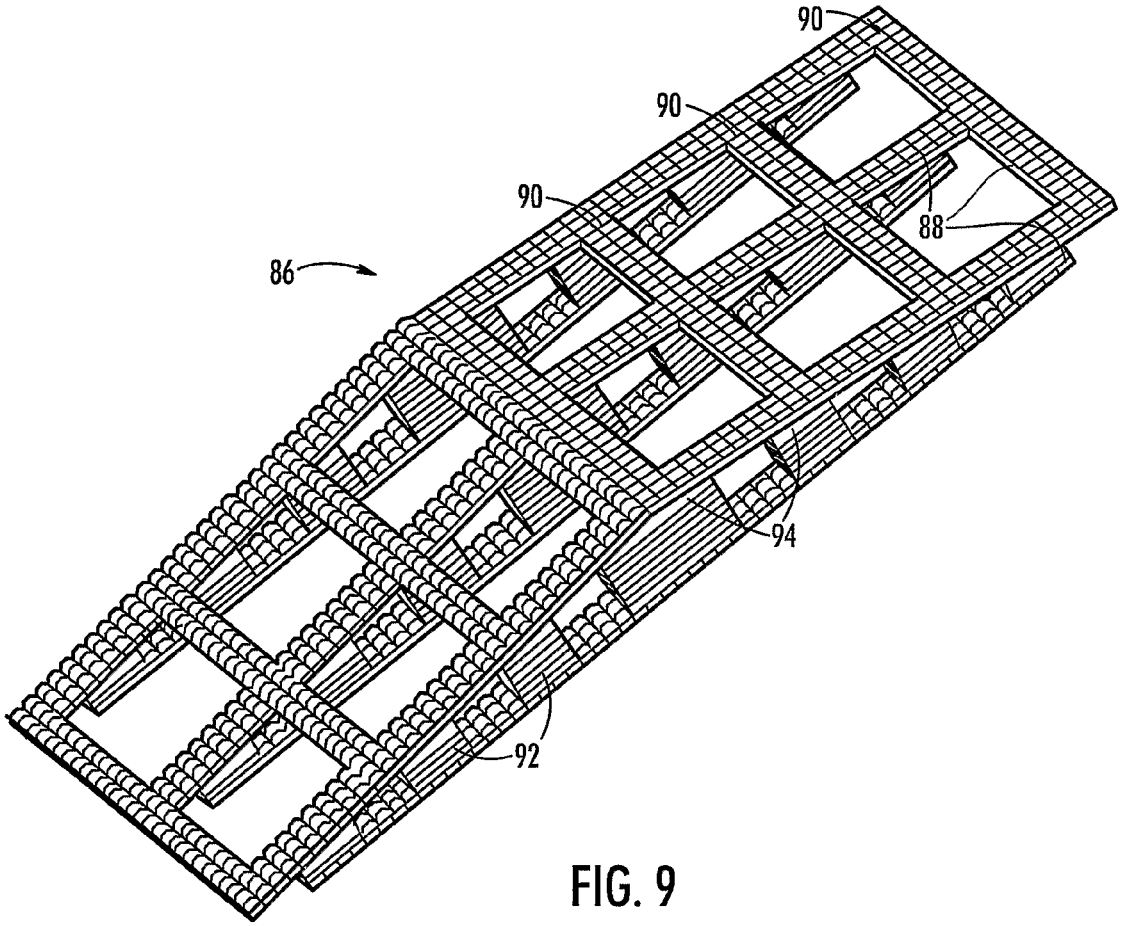
FIG. 9 is a perspective view of a truss structure built-up from a plurality of modular blocks.

FIG. 9 illustrates an example of a truss structure 86 which may built up from the modular blocks 10 described above. The modular blocks 10 are connected side-by side and vertically to form longitudinal members 88, lateral members 90, and vertical members 92. Tapered blocks 94 are disposed at the upper ends of the vertical members 92 so that the uppermost longitudinal members 88 will be at the proper angle.

Figure 10:
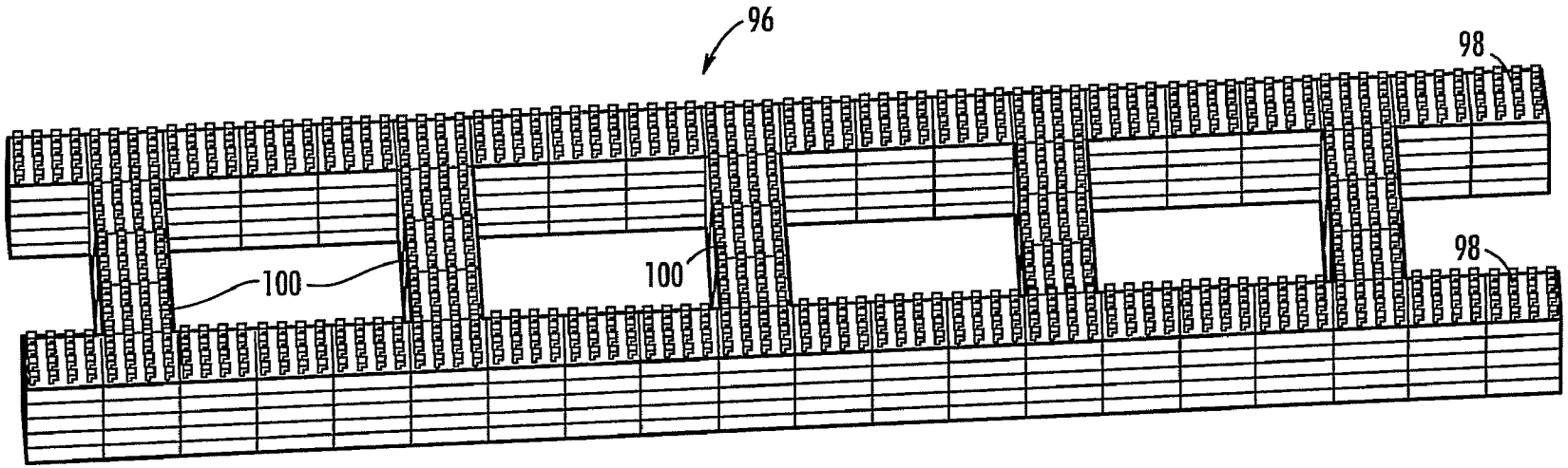
FIG. 10 is a perspective view of a wall structure built-up from a plurality of modular blocks.

FIG. 10 illustrates a ladder truss-type structure 96 having longitudinal members 98 and lateral members 100 which may be built up from modular blocks 10 described above.

Figure 11:
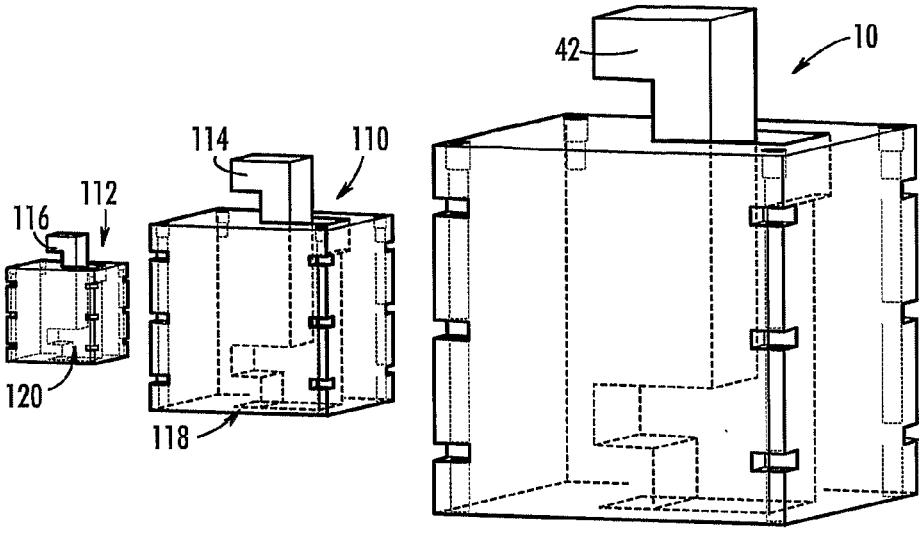
FIG. 11 is a perspective view of a group of modular blocks of different sizes.

FIG. 11 illustrates a modular block 10 alongside additional modular blocks 110 and 112. The modular blocks 110 and 112 are substantially identical in construction to the modular block 10, and include hooks 114 and 116, and locking recesses 118 and 120, respectively. The modular blocks 110 and 112 differ from the modular block 10 in their size. This may vary from a size small enough to construct items such as electronic circuit boards, to as many as several feet on a side for elements for constructing buildings.

Figure 12:
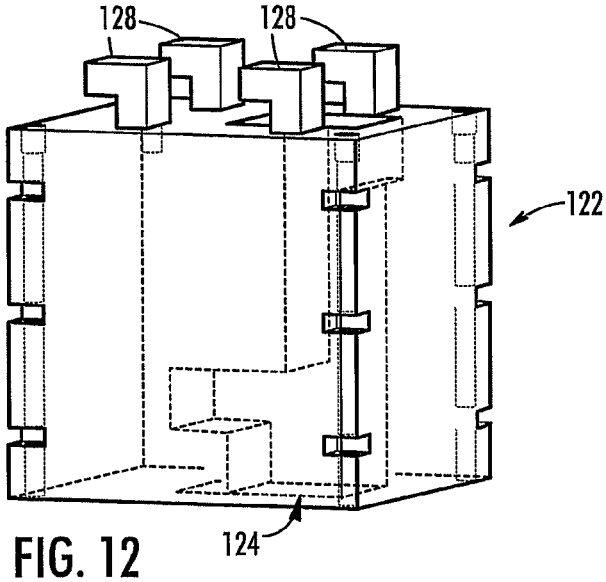
FIG. 12 is a perspective view of a modular block adapted to be connected to a plurality of smaller modular blocks.
Figure 13:
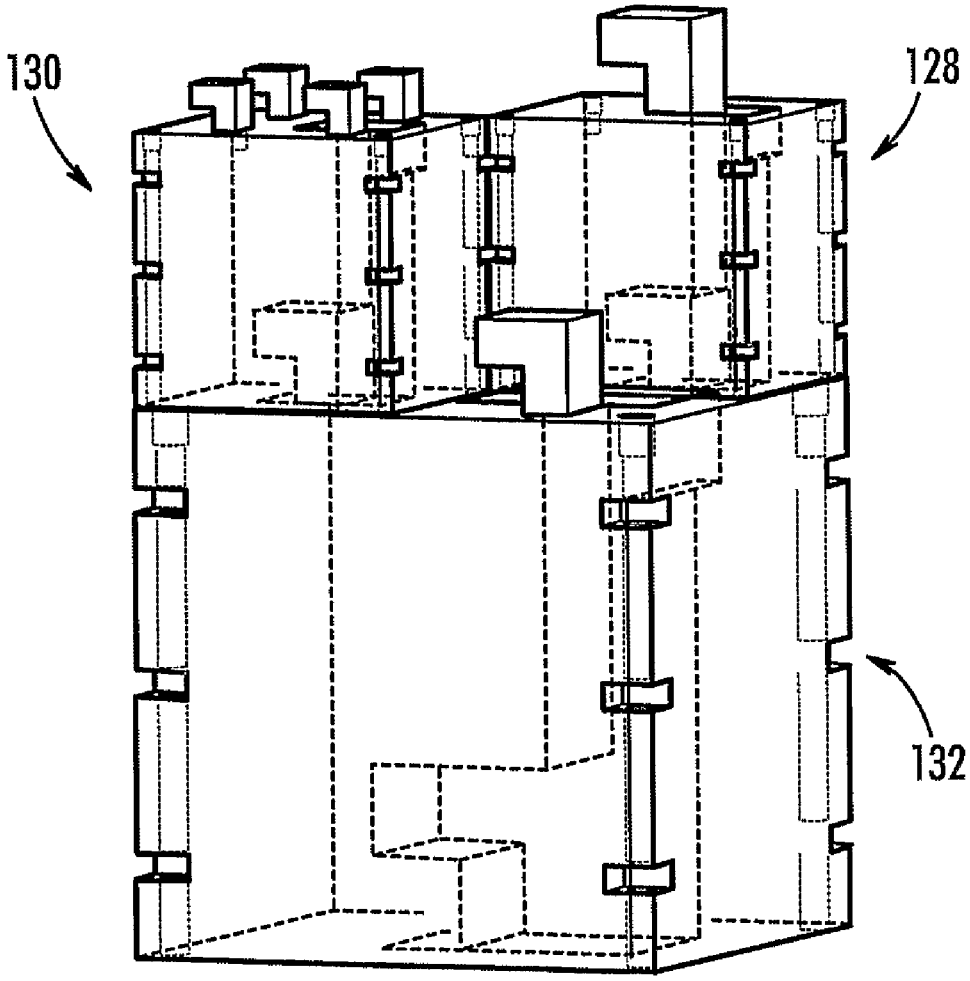
FIG. 13 is a perspective view of the modular block of FIG. 12 connected to a plurality of smaller modular blocks.

FIG. 12 illustrates a modular block 122 which is designed to serve as an "adapter" for connection to different-sized modular blocks. The modular block 122 includes a single locking recess 124 on its lower side. Four "L"-shaped hooks 126 protrude from the upper surface of the modular block 122. As shown in FIG. 13, this allows the modular block 122 to be connected to additional modular blocks 128 and 130 which are each one-quarter of the size of the modular block 122.

Figure 14:
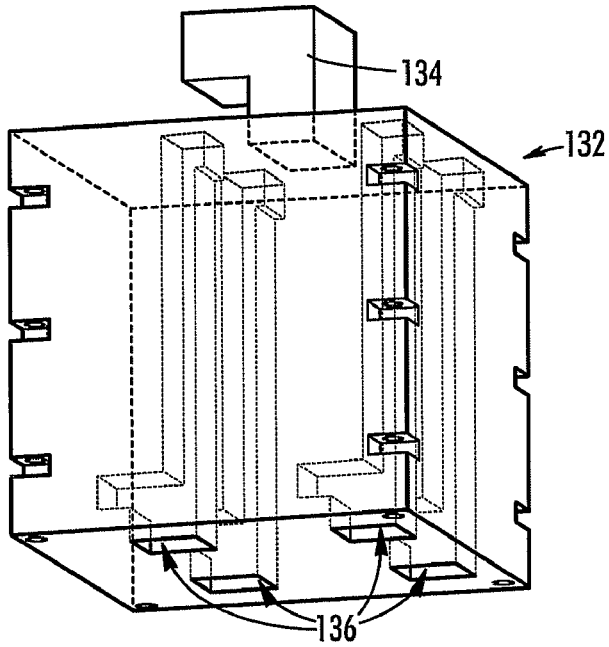
FIG. 14 is a perspective view of another modular block adapted to be connected to a plurality of smaller modular blocks.
Figure 15:
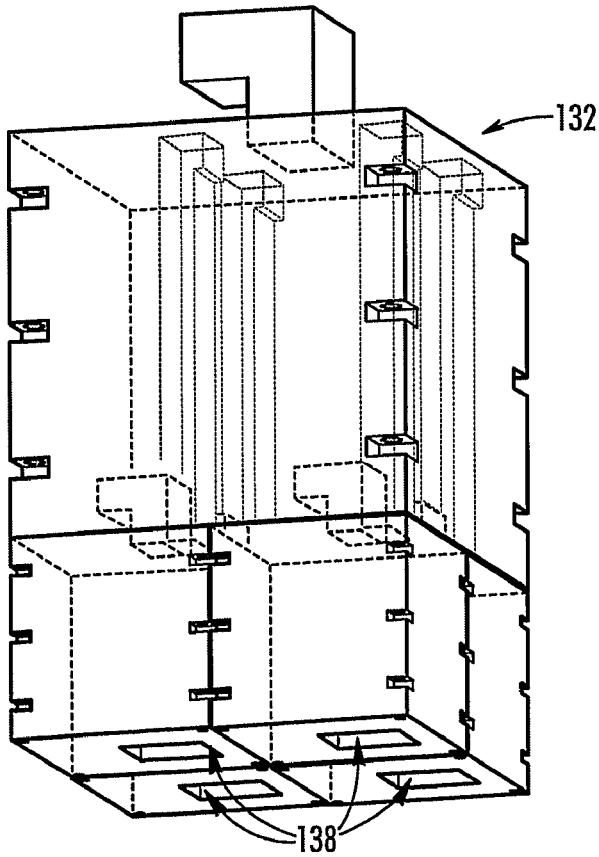
FIG. 15 is a perspective view of the modular block of FIG. 14 connected to a plurality of smaller modular blocks.

FIG. 14 illustrates another modular block 132 which is designed to serve as an "adapter" for connection to different-sized modular blocks. The modular block 132 includes a single "L"-shaped hook 134 protruding from its upper surface. Four locking recesses 136 are disposed on its lower side. As shown in FIG. 15, this allows the modular block 132 to be connected to additional modular blocks 138 which are each one-quarter of the size of the modular block 132.

Figure 16:
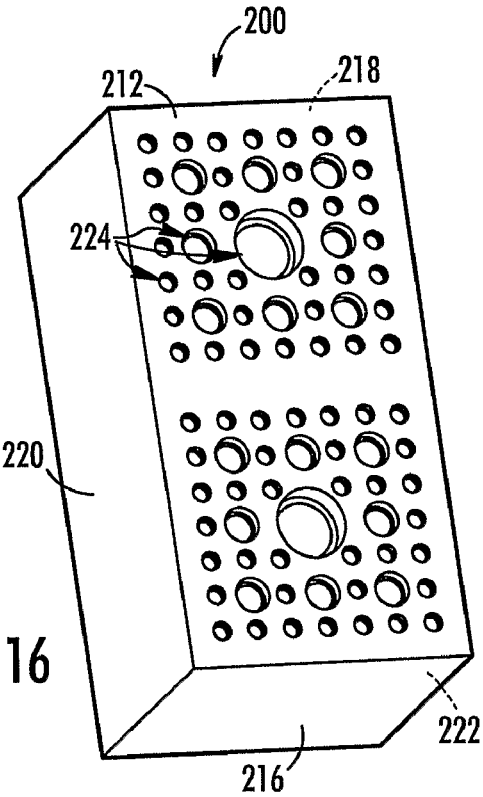
FIG. 16 is a top perspective view of a modular block constructed according to an alternative embodiment of the present invention.
Figure 17:
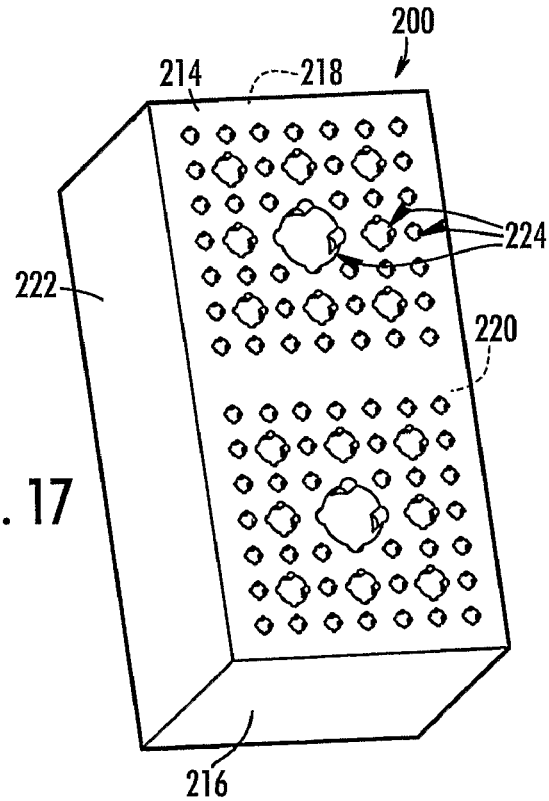
FIG. 17 is a bottom perspective view of the modular block of FIG. 16.
Figure 18:
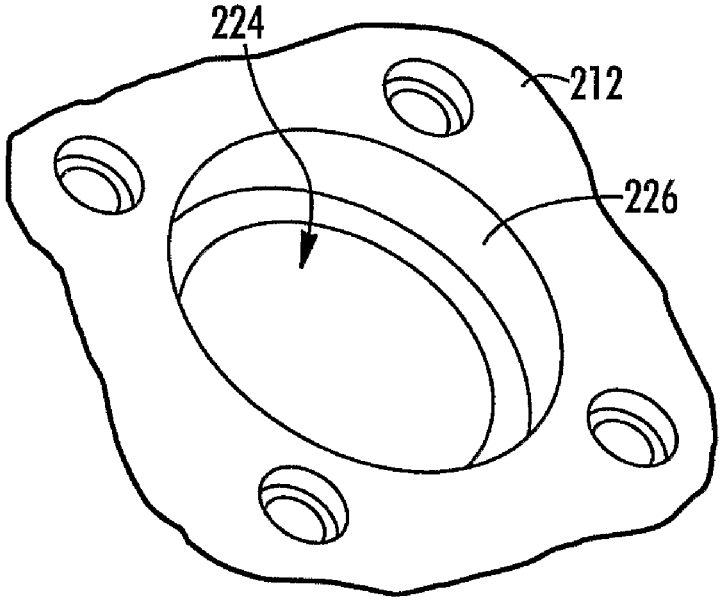
FIG. 18 is an enlarged view of a portion of the top of the modular block of FIG. 16.
Figure 19:
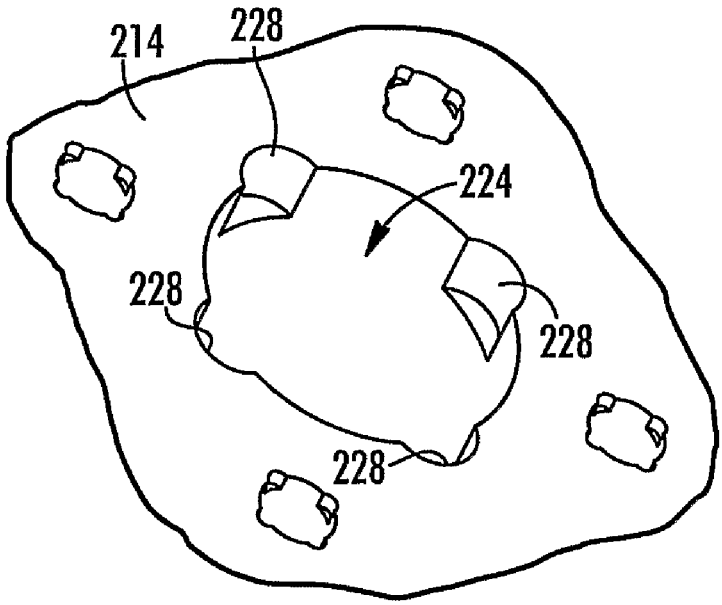
FIG. 19 is an enlarged view of a portion of the bottom of the modular block of FIG. 16.

FIGS. 16 and 17 illustrate an exemplary modular block 200 constructed according to the present invention. The modular block 200 is generally rectangular and includes a top surface 212, a bottom surface 214, and front, rear, left and right sidewalls 216, 218, 220, and 222, respectively. A plurality of generally cylindrical core passages 224 of various sizes pass through the modular block 200 from top to bottom. As shown in more detail in FIG. 18, each core passage 224 has an enlarged-diameter counterbore 226 formed at its upper end. As shown in more detail in FIG. 19, each core passage 224 has a plurality of semi-cylindrical key slots 228 formed around the periphery of its lower end.

Figure 20:
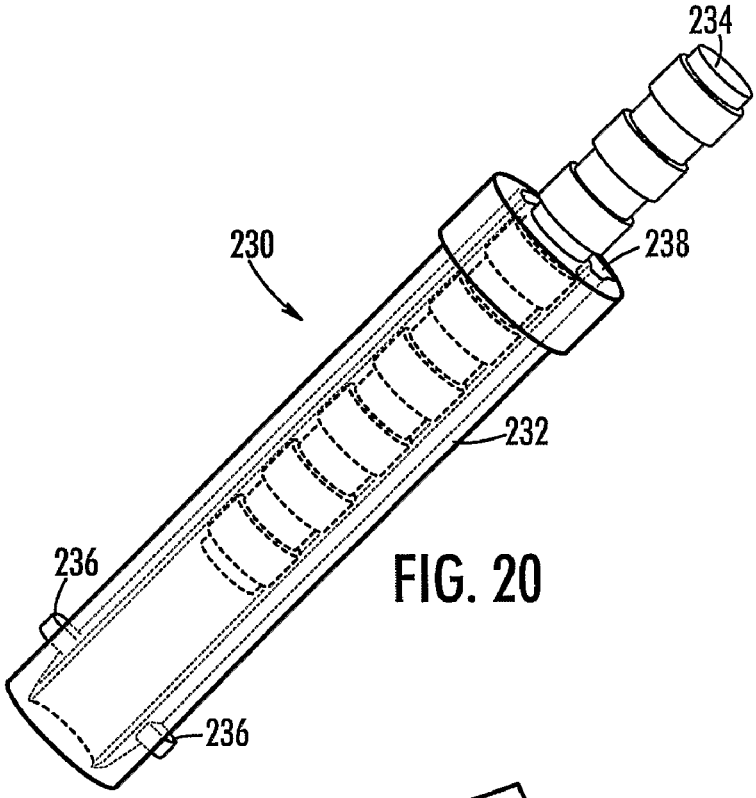
FIG. 20 is a perspective view of a locking assembly for use with the modular block of FIG. 16.
Figure 21:
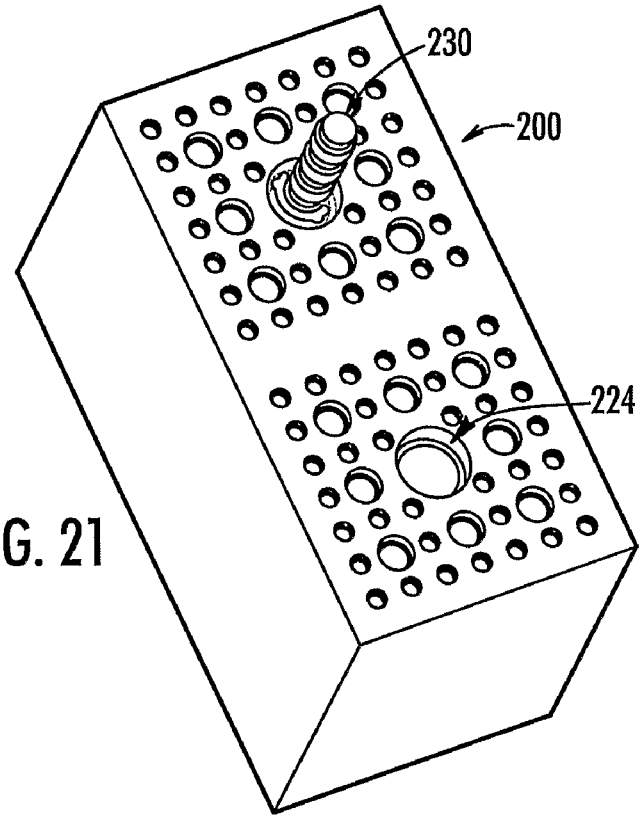
FIG. 21 is a top perspective view of a modular block having a locking assembly installed therein.
Figure 22:
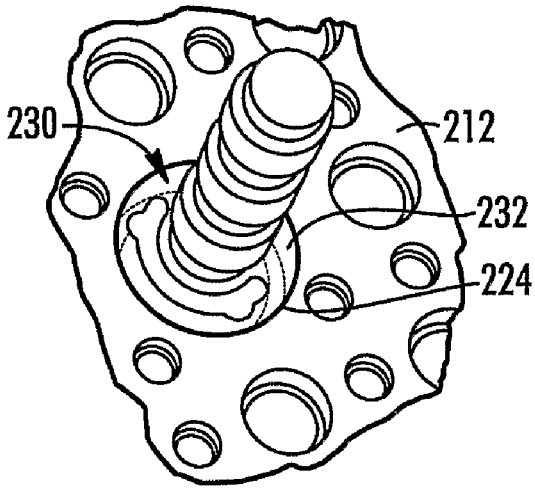
FIG. 22 is an enlarged view of a portion of the top of the modular block of FIG. 21.
Figure 23:
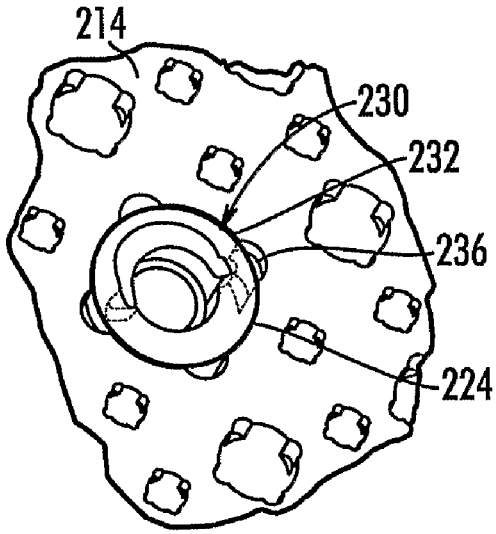
FIG. 23 is an enlarged view of a portion of the bottom of the modular block of FIG. 21.

FIG. 20 illustrates an exemplary locking assembly 230, which includes a core 232, a locking rod 234, one or more core keys 236, and a rod key 238, all of which are described in more detail below. The locking assembly 230 is received in one of the core passages 224 of a modular block 200 to enable the modular block 200 to be connected to other blocks, as shown in FIG. 21. The locking assembly 230 fits in the core passage 224 so that the upper end of the core 232 fits flush with the top surface 212 of the modular block 200, as shown in FIG. 22, and the lower end of the core is flush with the bottom surface 214 of the modular block 200, as shown in FIG. 23.

Figure 24A:
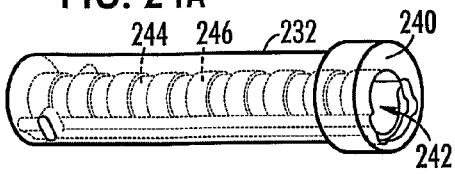
FIG. 24A is a perspective view of a core forming a portion of a locking assembly.

FIGS. 24A through 24E illustrate the assembly sequence of the locking assembly 230. Referring to FIG. 24A, the generally cylindrical core 232 has an enlarged boss 240 formed at its upper end which is sized and shaped to fit into the counterbore 226 of the core passage 224. The core 232 has a through-bore 242 passing along its length. Approximately one-half of the through-bore 242 defines a series of alternating semi-cylindrical core grooves 244 and core lands 246. The core grooves 244 have a first inner diameter, and the core lands 246 have a second inner diameter which is smaller than the first inner diameter. The remaining portion of the through-bore 242 is formed into a semi-cylindrical passage 247 having an inner diameter somewhat larger than the first inner diameter.

Figure 24B:
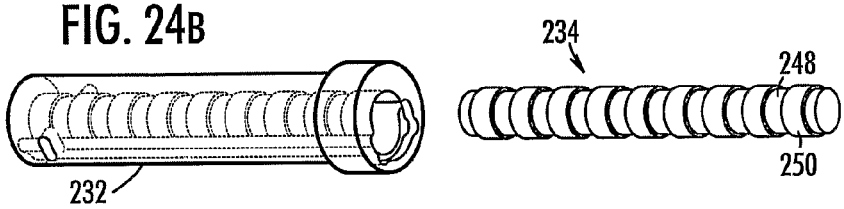
FIG. 24B is a perspective view of the core of FIG. 24A with a locking rod about to be inserted therein.

FIG. 24B illustrates a locking rod 234. The locking rod 234 is generally cylindrical. Its outer surface defines a series of alternating cylindrical rod grooves 248 and rod lands 250. The rod lands 250 have a first outer diameter which is approximately equal to the first inner diameter of the core grooves 244, and the rod grooves 248 have a second outer diameter which is approximately equal to the second inner diameter of the core lands 246.

Figure 24C:
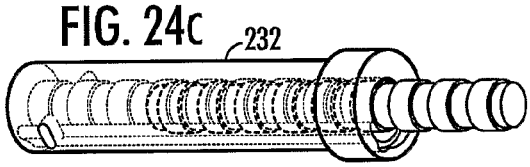
FIG. 24C is a perspective view of the core and locking rod of FIG. 24B connected together.

FIG. 24C shows the locking rod 234 inserted into the core 232 and shifted laterally so that the rod lands 250 engage the core grooves 244, and the rod grooves 250 engage the core lands 246. Thus engaged, the locking rod 234 is prevented from moving axially relative to the core 232. The locking rod 234 is inserted approximately halfway into the core 232, so that a space will be left in the core for receiving another locking rod 234 in a manner described below.

Figure 24D:
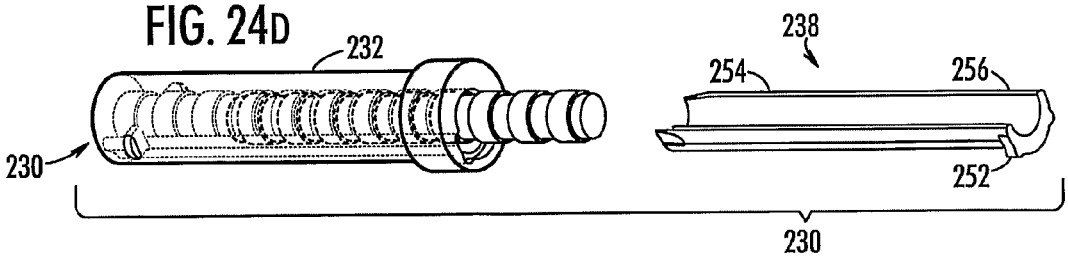
FIG. 24D is a perspective view of the core and locking rod of FIG. 24C with a rod key about to be inserted therein.
Figure 24E:
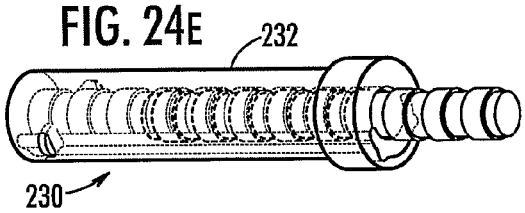
FIG. 24E is a perspective view of the core and locking rod of FIG. 24C with a rod key fully inserted therein.

FIG. 24D shows a rod key 238 about to be inserted into the core 232. The rod key is an elongated, arcuate cross-section member with a laterally-extending lip 252 at its upper end. The outer wall 254 of the rod key 238 mates with the semi-cylindrical passage 247 of the core 232, and the inner wall 256 of the rod key 238 mates with the rod lands 250. When the rod key 238 is fully inserted into the core 232, it prevents the locking rod 234 from shifting laterally and thus retains it in the core.

Figure 25:
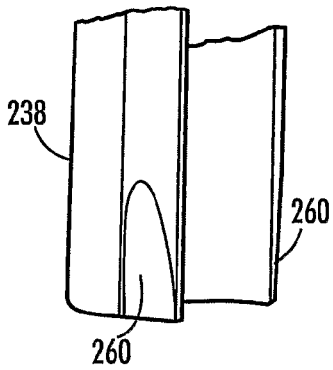
FIG. 25 is a perspective view of a lower end of a rod key.
Figure 26:
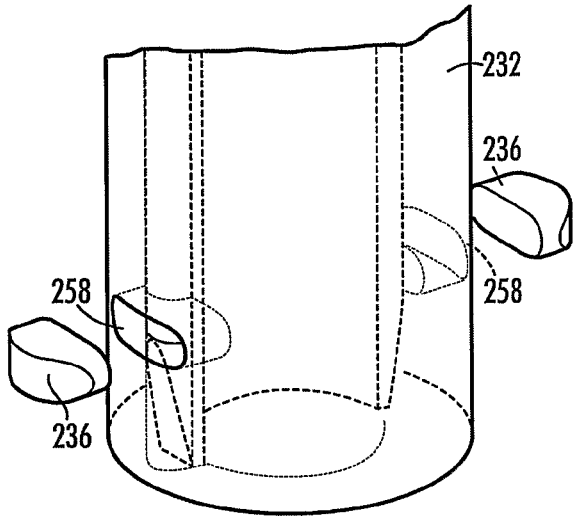
FIG. 26 is a perspective view of a core along with a rod key and a pair of core keys.

A pair of oblong core keys 236, best seen in FIG. 26, are disposed in core key openings 258 near the bottom end of the core 232 so that they can slide transversely to the long axis of the core 232. The rod key 238 has opposed chamfers 260 at its bottom end (see FIG. 25) which engage the core keys 236 and force them outwards as the rod key 238 is fully inserted into the core 232.

The locking assembly 230 is attached to a modular block 200 as follows. First, the core 232 with retracted core keys 236 is inserted into one of the core passages 224 of the modular block 200. The locking rod 234 is then inserted into the through-bore 242 and shifted laterally as described above. The rod key 238 is then inserted into the core 232, securing the locking rod 234 in place and also forcing the core keys 236 outward. As seen in FIG. 23, the core keys 236 engage the key slots 228 of the core passage 224. The entire locking assembly 230 is thus securely attached to the modular block 200 and cannot be removed until the rod key 238 is removed. If desired, the materials, dimensions, and finish of the rod key 238 may be chosen to prevent its unintended removal from the core passage 224. Furthermore, the rod key 238 may be provided with a means for assisting its removal, such as a fingernail slot or tool ledge (not shown).

Figure 27:
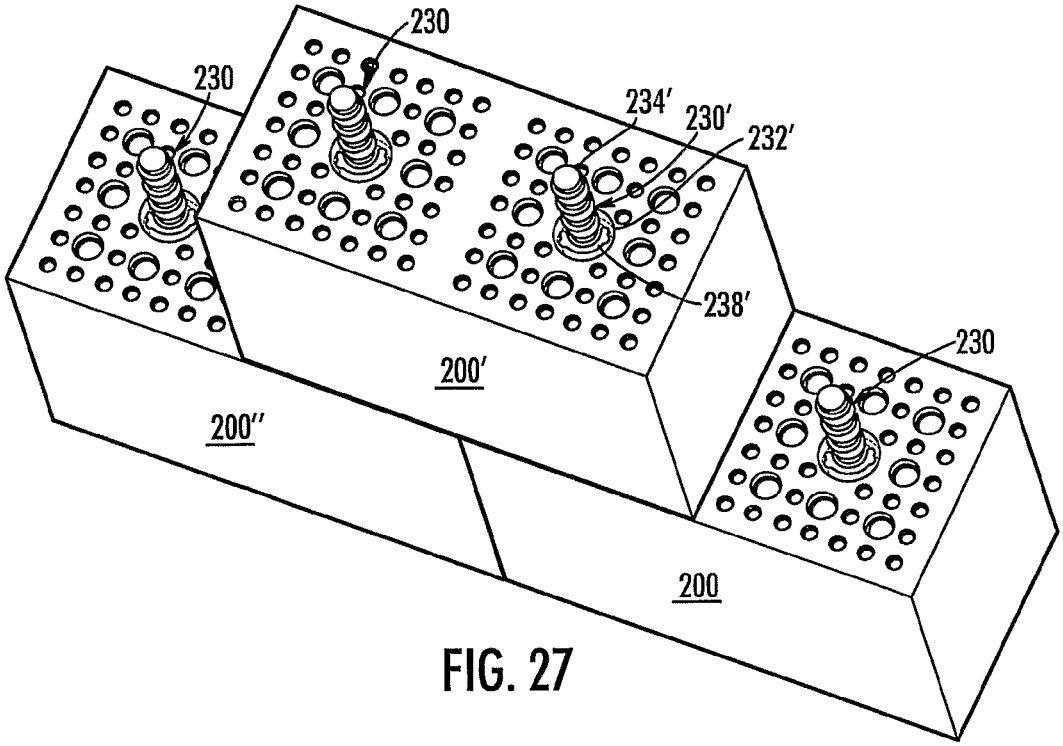
FIG. 27 is a perspective view of a plurality of modular blocks connected together.

FIG. 27 shows a group of modular blocks 200, 200', and 200" connected together with a plurality of locking assemblies 230. To assemble the modular blocks 200 and 200' together, a locking assembly 230 is first installed into a core passage 224 so that approximately half of the locking rod 234 extends upward from the top surface 212 of the modular block 200 (see FIG. 21). Then, a second core 232' is inserted into the upper modular block 200' without a locking rod 234 or rod key 238. The locking rod (obscured in FIG. 27) is inserted into the second core 232' and shifted laterally so that its grooves and lands engage the grooves and lands of the second core 232', similar to the manner described above with respect to FIGS. 24A-24E. At this point, the modular blocks 200 and 200' are assembled in an upper-and-lower touching relationship. If desired, a second locking rod 234' may be inserted into the second core 232 and engaged with the grooves and lands thereof. A second rod key 238' is then inserted into the second core 232 to lock both of the locking rods 234 and 234' into place in the second core 232' and prevent disassembly of the modular blocks 200 and 200'.

Figure 28:
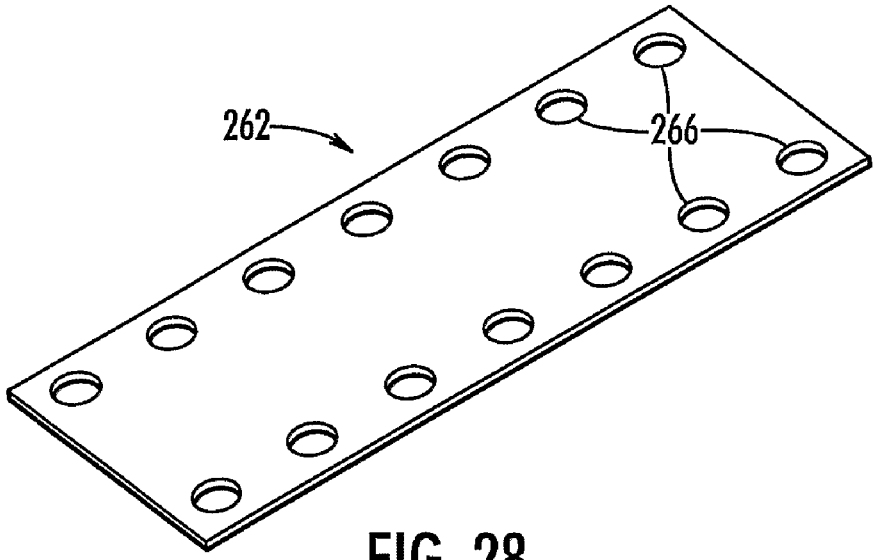
FIG. 28 is a perspective view of a connector plate.

FIG. 28 illustrates a connector plate 262 for being used to join two or more modular blocks 200 together side-by-side. The illustrated connector plate 262 is a flat member having a thickness sized to fit in a connector slot 264 formed in the periphery of a modular block 200 (see FIG. 29). One or more connector pin holes 266 are formed through the connector plate 262. In the illustrated example, the connector plate 262 is rectangular and has a two-dimensional array of connector pin holes 266 therein.

Figure 29:
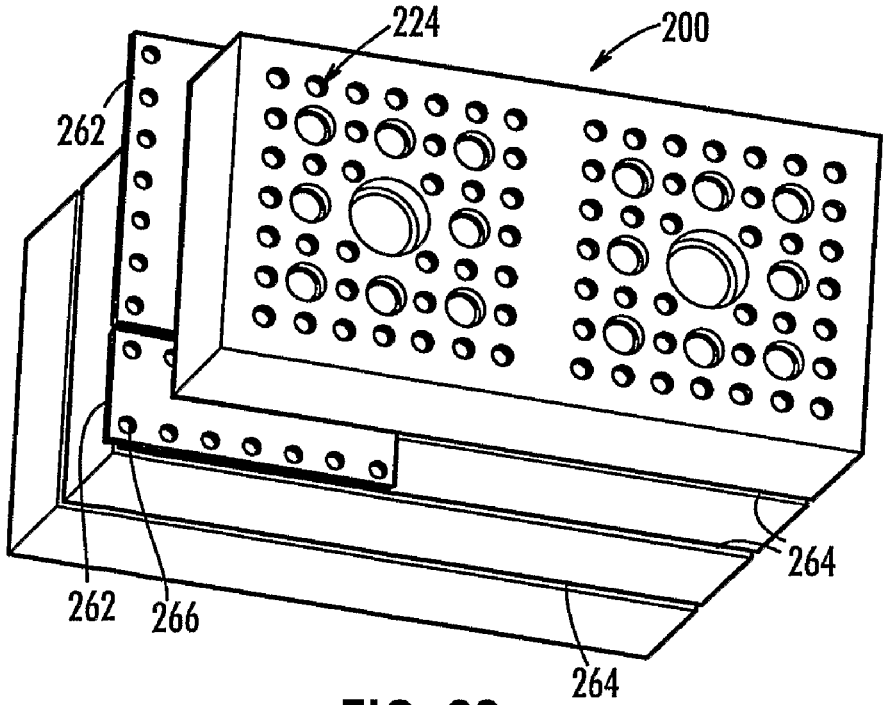
FIG. 29 is perspective view of a connector plate disposed in a groove of a modular block.
Figure 30:
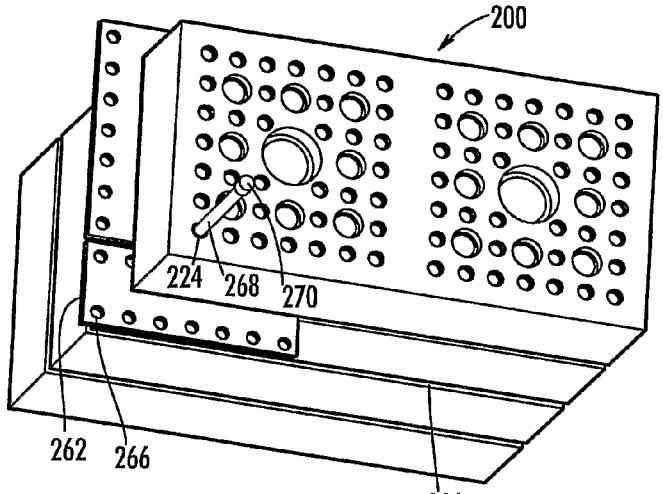
FIG. 30 is a perspective view of the modular block and connector plate of FIG. 29 with a connector pin inserted therein.

As shown in FIGS. 29 and 30, some of the core passages 224 in the modular block 200 intersect the connector slots 264 thereof. A connector pin 268, is sized to fit the core passage 224. It may include an enlarged head 270 to prevent it from falling through the modular block 200.

Figure 31:
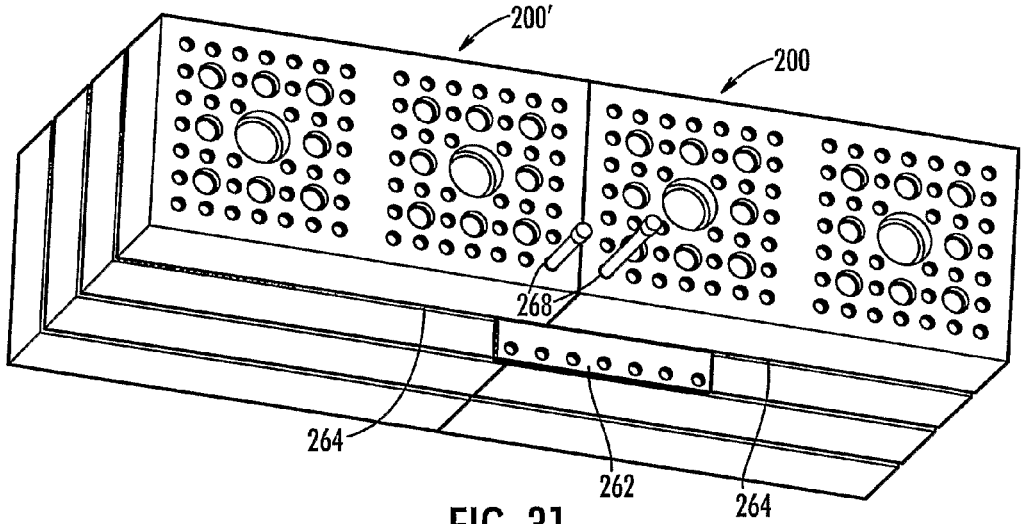
FIG. 31 is a perspective view of a pair of modular blocks connected end-to-end with a connector plate and connector pins.

FIG. 31 illustrates two modular blocks 200 and 200' connected end-to-end. A connector plate 262 is inserted into connector slots 264 of each of the modular blocks 200 and 200'. A connector pin 268 is then inserted into core passages 224 of each of the modular blocks 200 and 200', passing through the connector pin holes (obscured in FIG. 31). This secures each of the modular blocks 200 and 200' to the connector plate 262 and thus secures the modular blocks 200 and 200' to each other, in both lateral and vertical directions.

Figure 32:
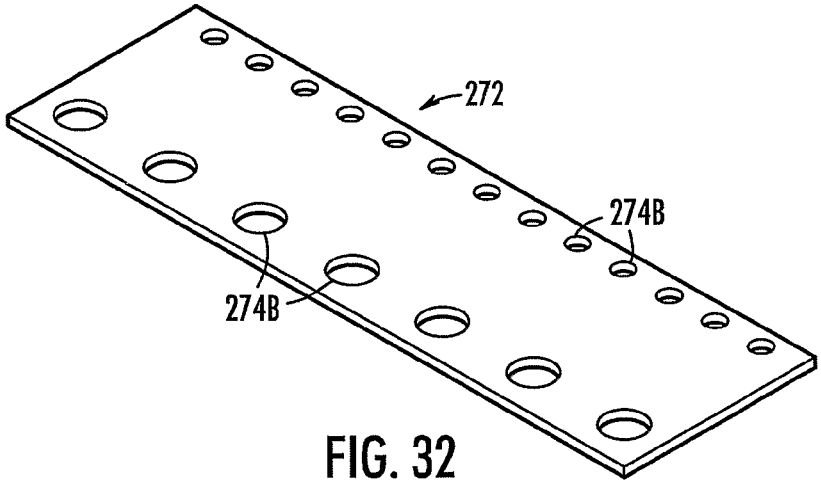
FIG. 32 is a perspective view of another type of connector plate.
Figure 33:
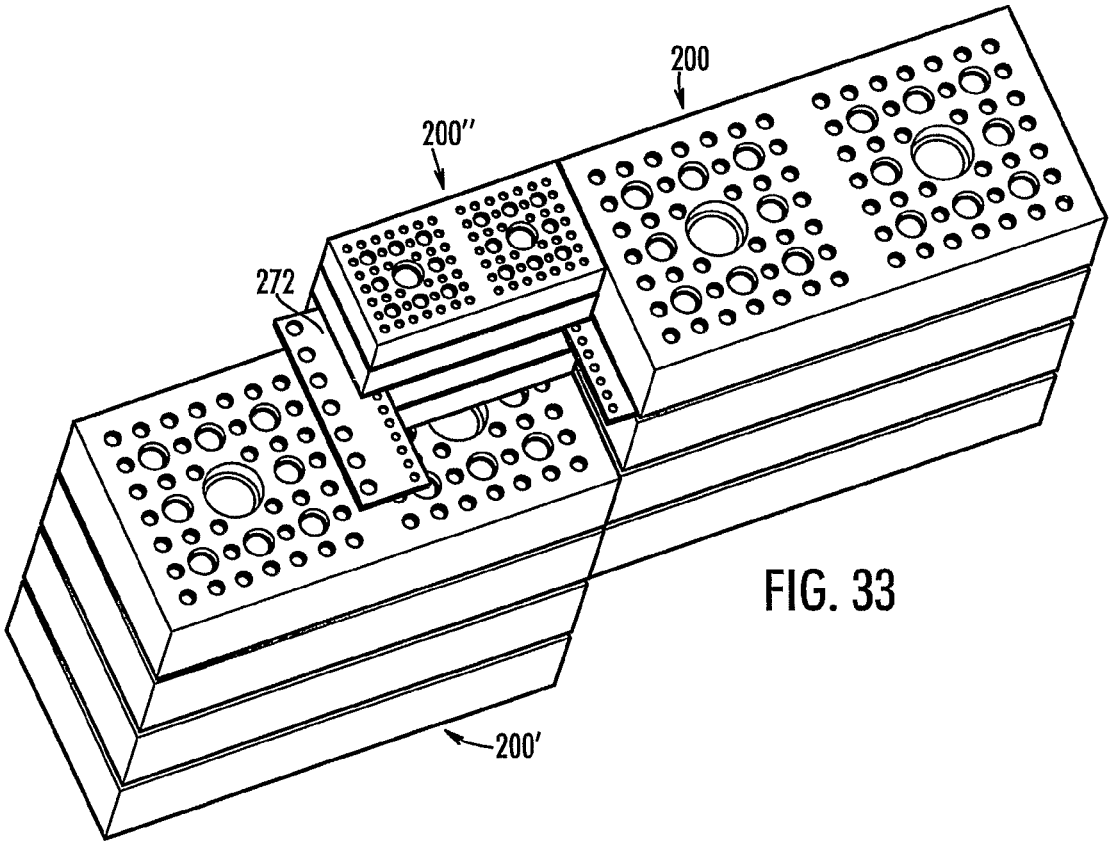
FIG. 33 is a perspective view of a plurality of modular blocks of varying sizes connected together.

FIG. 32 illustrates another connector plate 272 for being used to join two or more modular blocks 200 together. The illustrated connector plate 272 is substantially similar to the connector plate 262 described above, differing only in the fact that it includes an array of relatively small-diameter connector pin holes 274A, and another array of relatively larger connector pin holes 274B are formed through the connector plate 272. The connector plate 272 can be used to join modular blocks 200 having different-sized core passages 224. As shown in FIG. 33, this allows the joining of relatively large modular blocks 200 and 200' with a smaller modular block 200".

FIG. 34 illustrates a finish element 276. The finish element 276 has a planar inner side 278 which is dimensioned and shaped to mate with a side wall of the modular block 200. The inner side 278 includes one or more connector tabs 280 with connector pin holes 282 therein. The connector tabs 280 are positioned and sized to fit into the connector slots 264 of the modular block 200. The finish element 276 has an exterior surface 284 with one or more sides or facets which are formed into a desired shape. In the illustrated example, the exterior surface 284 of the finish element 276 is shaped to form a portion of a cylinder.

FIG. 35 illustrates a modular block 200 with several finish elements 276 attached thereto. They may be secured with connector pins (not shown) as described above, to form a solid structure with a cylindrical outer surface. The use of finish elements 276 allows the creation of structures that are modular, but which have arbitrary external shapes.

Figure 36:
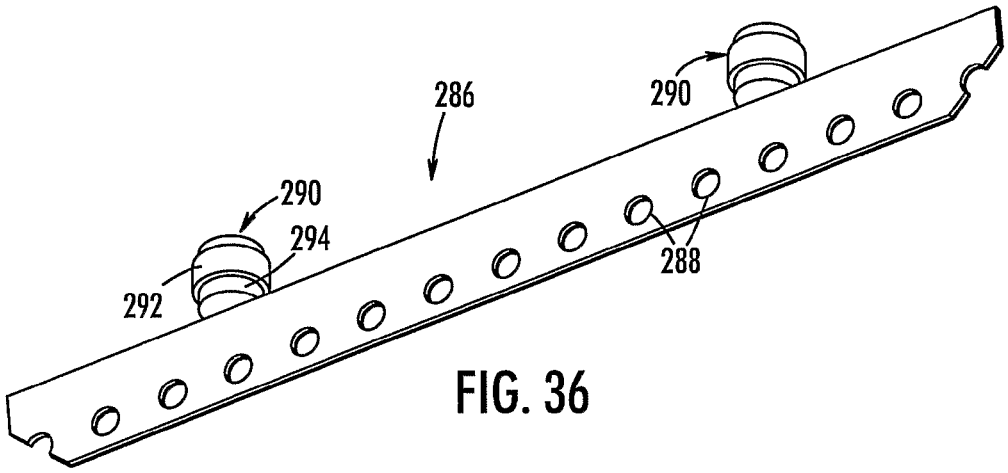
FIG. 36 is a perspective view of a rotational connector plate.
Figure 37:
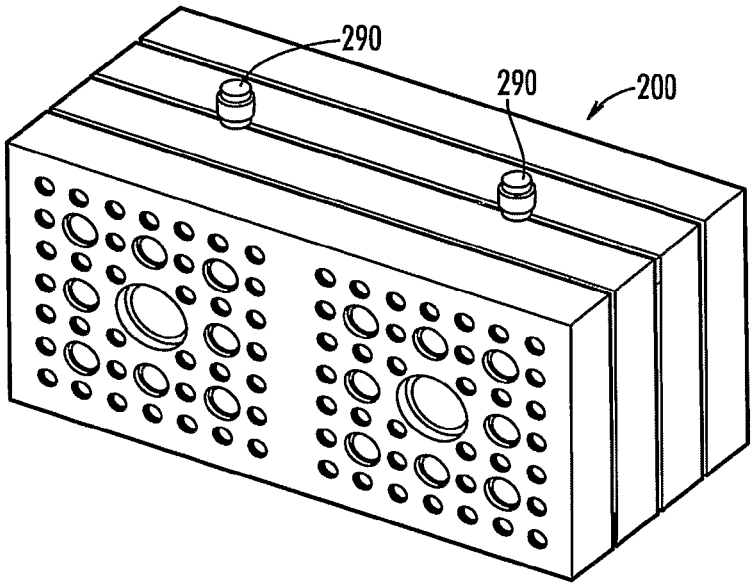
FIG. 37 is a perspective view of a modular block with the connector plate of FIG. 36 attached thereto.
Figure 38:
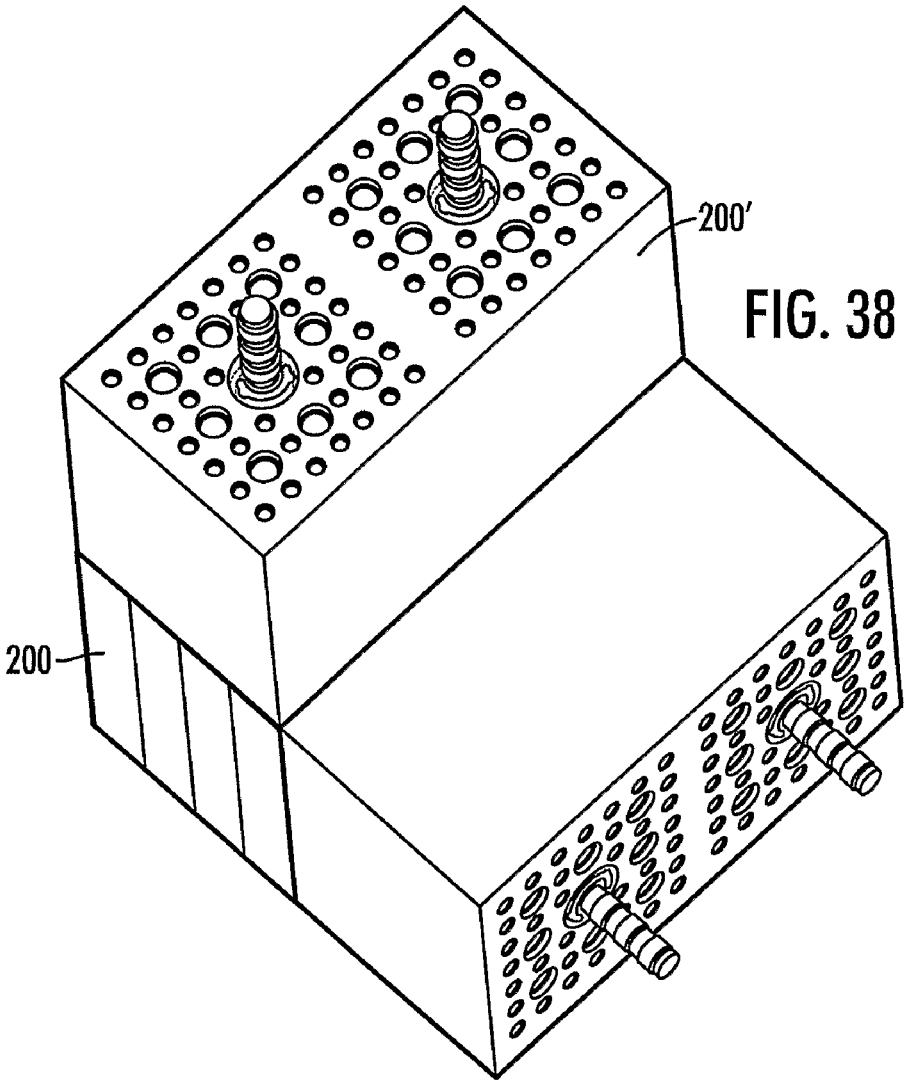
FIG. 38 is a perspective view of a plurality of modular blocks connected together.

FIG. 36 illustrates another type of connector plate 286. The connector plate 286 is a flat member having a thickness sized to fit in a connector slot 264 formed in the periphery of a modular block 200. An array of connector pin holes 288 are formed through the connector plate 286. One or more cylindrical studs 290, each having at least one cylindrical land 292 and one cylindrical groove 294, are attached to the connector plate 286 and are extend parallel to the plane thereof. The installation of the connector plate 286 into a connector slot 264, as shown in FIG. 37, gives the side of a modular block 200 the same connectivity as the top of the modular block 200. More particularly, the studs 290 perform the same function as the locking rods 236 so that a modular block 200' can be connected to the side of a modular block 200 (see FIG. 38).

Figure 39:
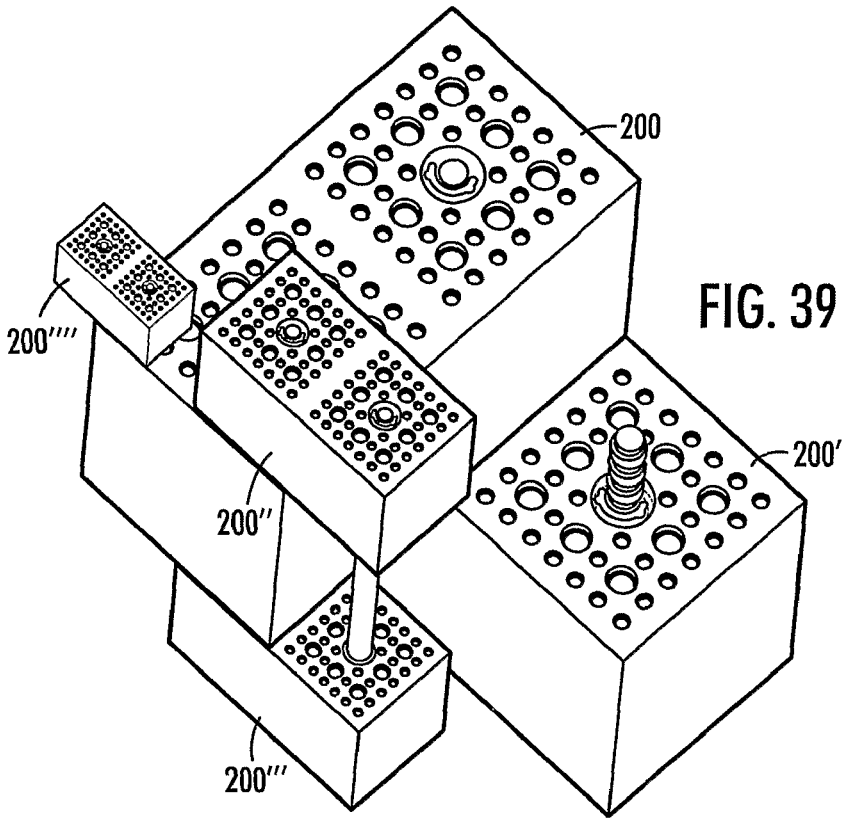
FIG. 39 is a perspective view of a plurality of modular blocks of varying sizes connected together.
Figure 43:
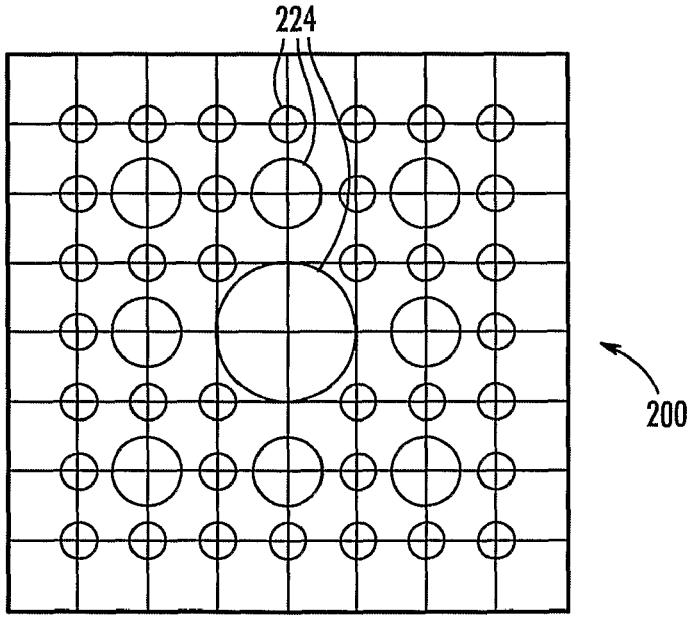
FIG. 43 is a schematic top view of a representative hole pattern in a modular block.
Figure 42:
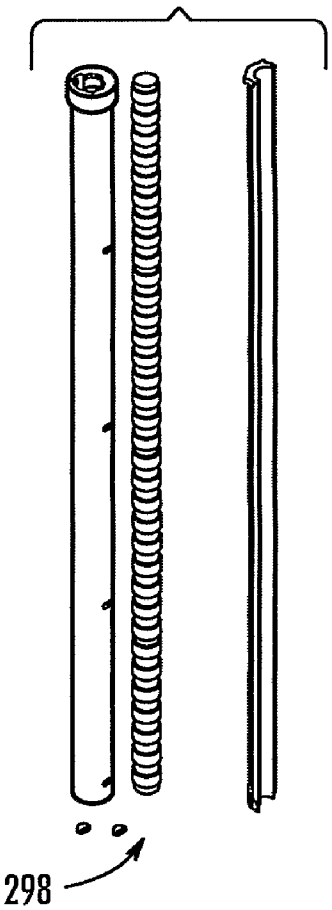
FIG. 42 is a perspective view of the components of a locking assembly of a third size.
Figure 41:
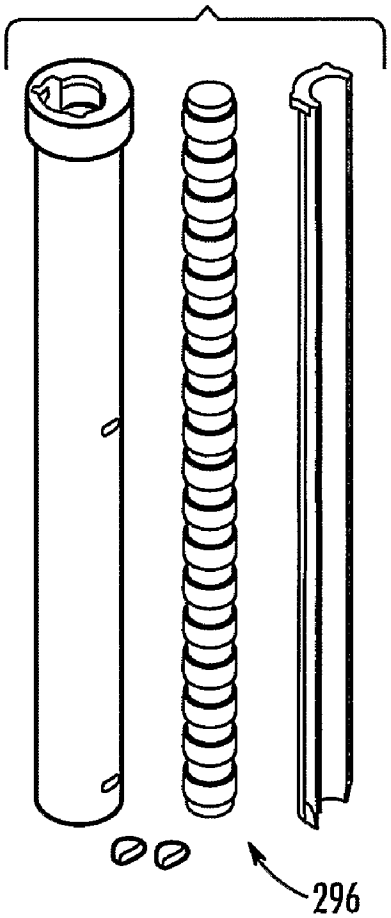
FIG. 41 is a perspective view of the components of a locking assembly of a second size.
Figure 40:
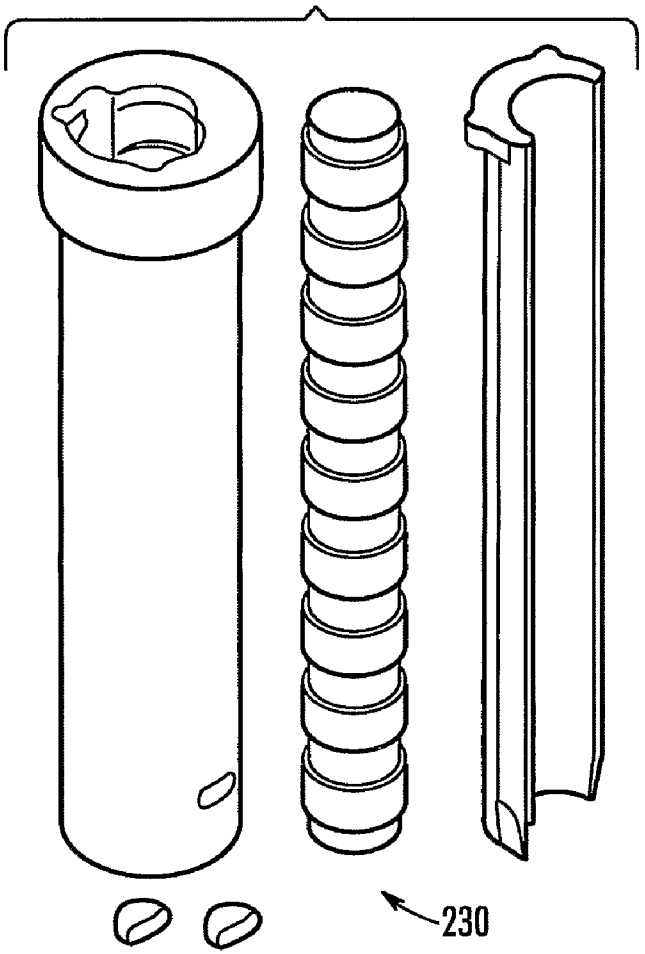
FIG. 40 is a perspective view of the components of a locking assembly of a first size.

FIG. 39 illustrates how various sizes of modular blocks 200, 200', 200", 200'", and 200"" may be connected to each other by using appropriately-sized locking assemblies 230 in the core passages 224. Exemplary locking assemblies 230, 296, and 298, varying only in the size of their constituent components, are shown in FIGS. 40, 41, and 42, respectively. The use of these different-sized locking assemblies 230, 296, and 298 is enabled by the provision of different-sized core passages 224 in the modular blocks 200. As shown in FIG. 43, these core passages 224 are laid out in a regular grid pattern within the modular block 200.

Figure 44:
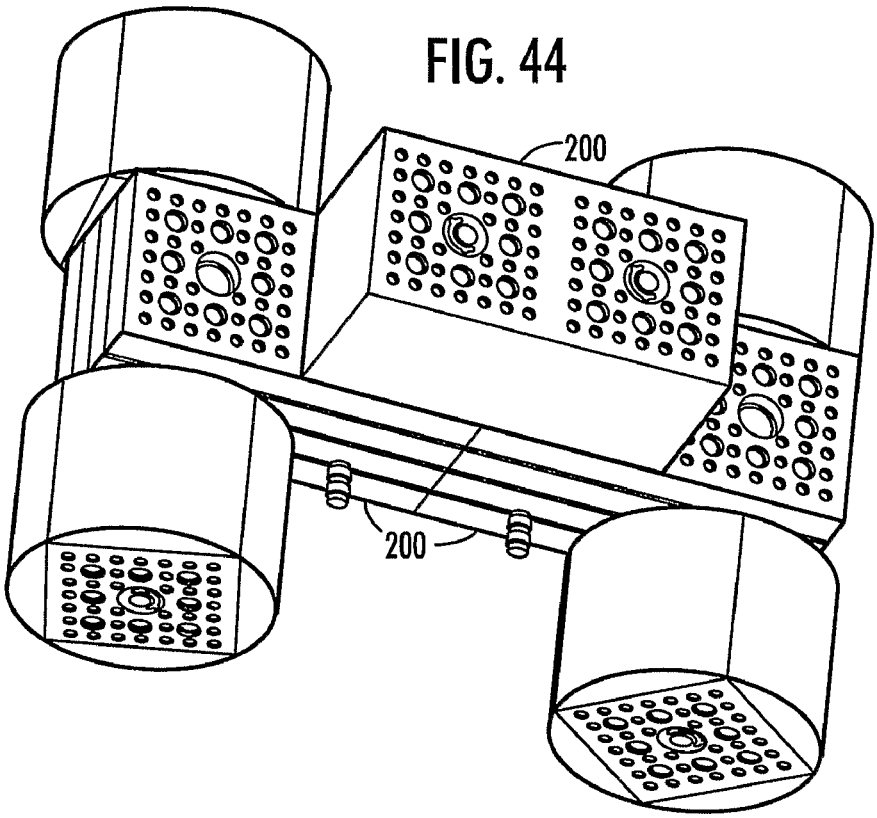
FIG. 44 is a perspective view of a wheeled vehicle constructed from modular blocks.
Figure 45:
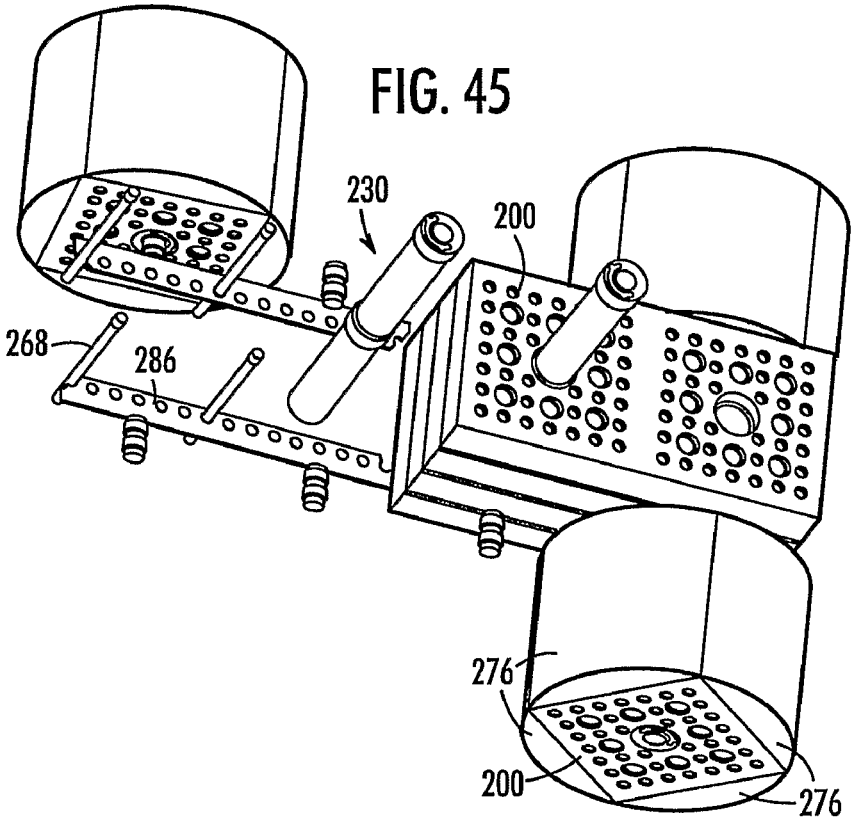
FIG. 45 is partially exploded view of the vehicle of FIG. 44.

FIGS. 44 and 45 illustrate an example of how a complex structure, in this case a wheeled vehicle, can be built up from the components described above, including modular blocks 200, locking assemblies 230, finish elements 276, connector plates 286, and connector pins 268

Figure 46:
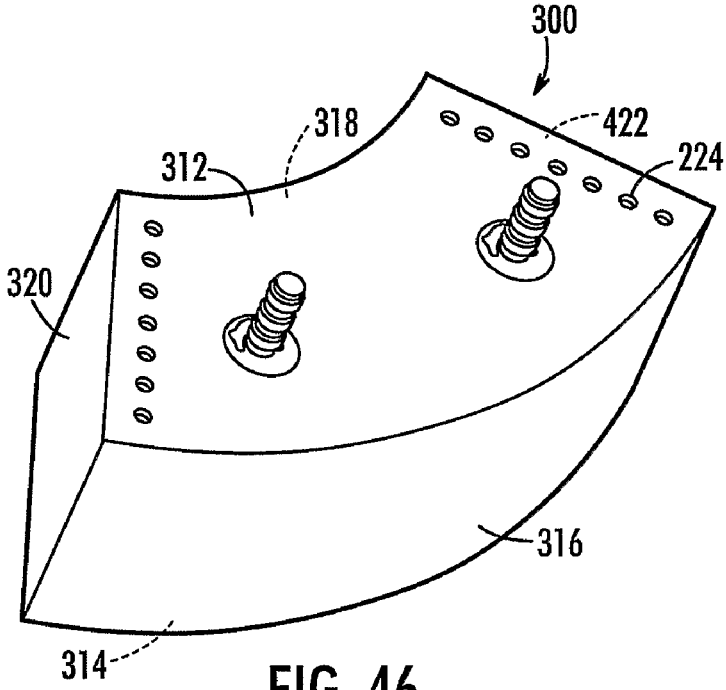
FIG. 46 is a perspective view of a curved modular block.
Figure 47:
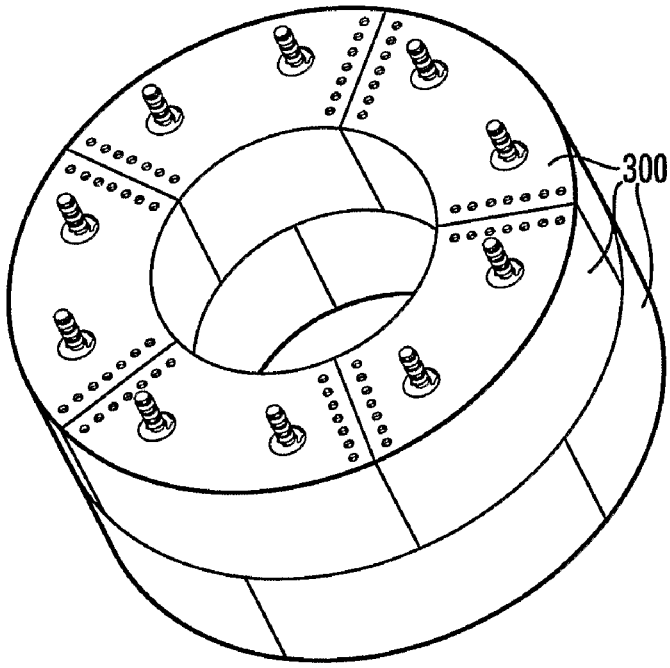
FIG. 47 is a perspective view of a cylindrical structure assembled from the modular blocks shown in FIG. 46.
Figure 48:
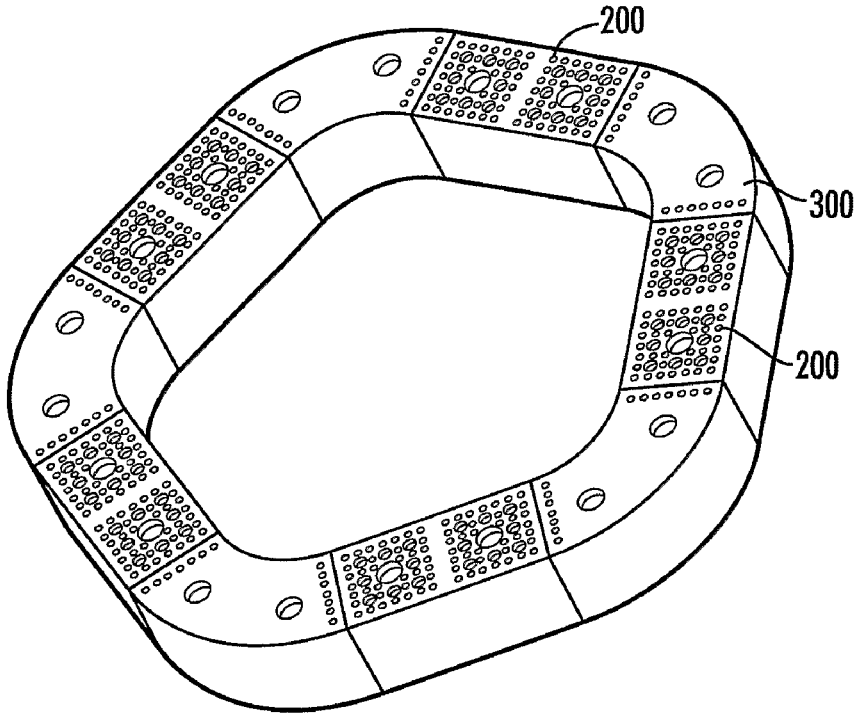
FIG. 48 is a perspective view of a structure assembled from a combination of curved and straight modular blocks.

The modular blocks need not be square or rectangular. For example, FIG. 46 illustrates a curved modular block 300. The curved modular block 300 includes a top surface 312, a bottom surface 314, and front, rear, left and right sidewalls 316, 318, 320, and 322, respectively. The front and rear sidewalls 316 and 318 are curved into parallel arcs. A plurality of generally cylindrical core passages 224 pass through the curved modular block 300 from top to bottom. As shown in FIGS. 47 and 48, these curved modular blocks 300 can be used solely with other curved modular blocks 300, or with rectangular modular blocks 200 to form structures with a desired shape.

Figure 49:
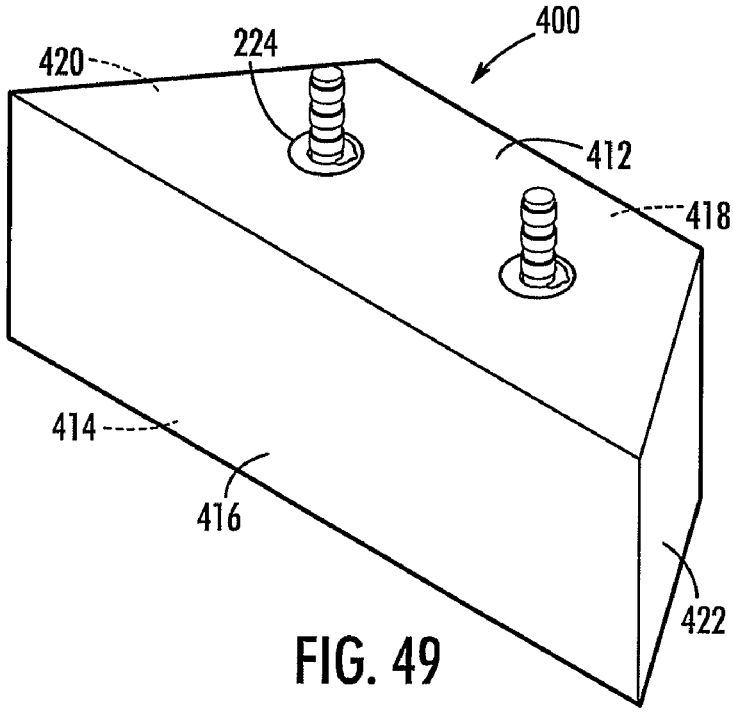
FIG. 49 is a perspective view of trapezoidal modular block.
Figure 50:
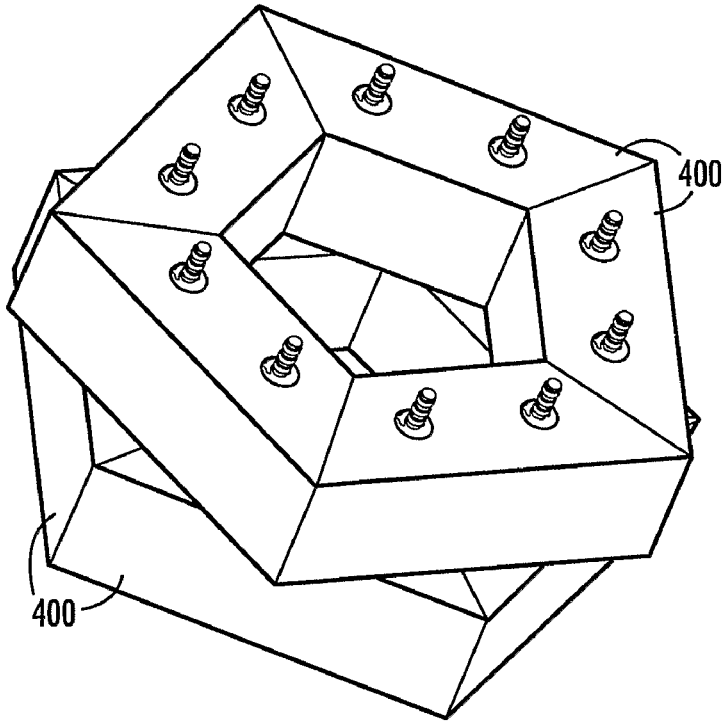
FIG. 50 is a perspective view of a structure assembled from the trapezoidal modular blocks shown in FIG. 49.

FIG. 49 illustrates a trapezoidal modular block 400. The trapezoidal modular block 400 includes a top surface 412, a bottom surface 414, and front, rear, left and right sidewalls 416, 418, 420, and 422, respectively. The left and right sidewalls 420 and 422 are angled in opposite directions. A plurality of generally cylindrical core passages 224 pass through the curved modular block 300 from top to bottom. As shown in FIG. 50, these trapezoidal modular blocks 400 can be used with other trapezoidal modular blocks 400 to produce polygonal structures.

Figure 51:
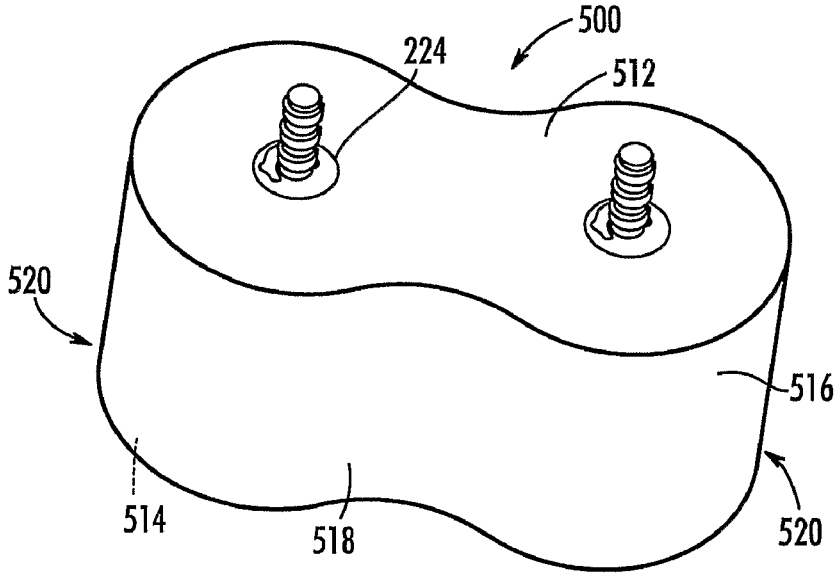
FIG. 51 is perspective view of a lobed modular block.
Figure 52:
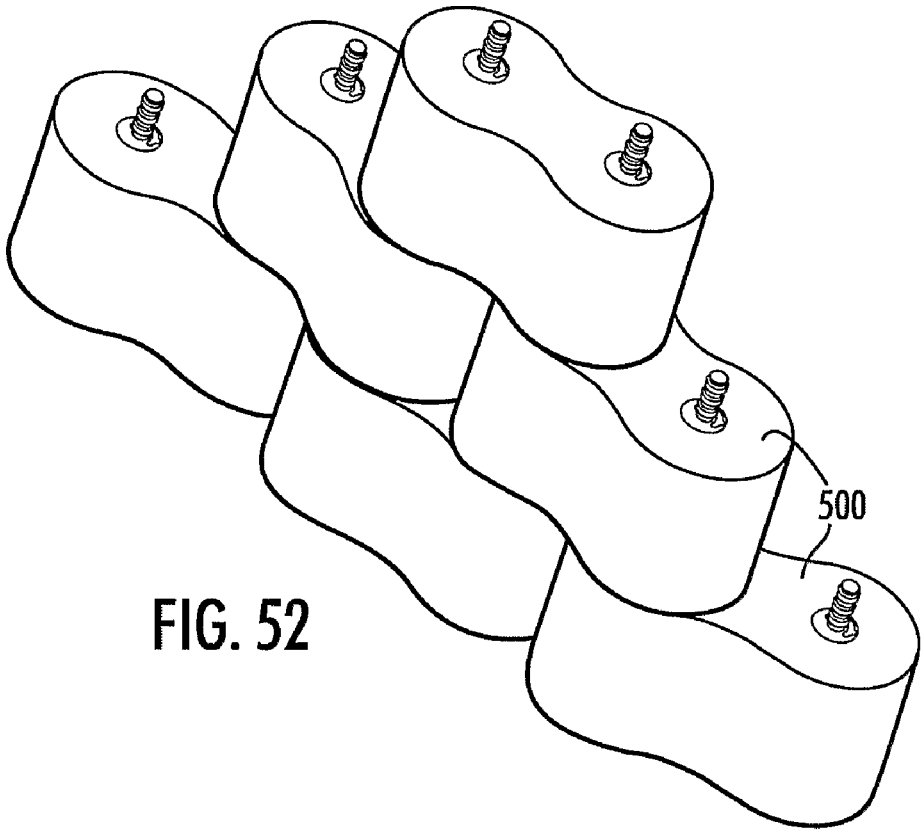
FIG. 52 is a perspective view of a wall structure assembled from the lobed modular blocks shown in FIG. 51.
Figure 53:
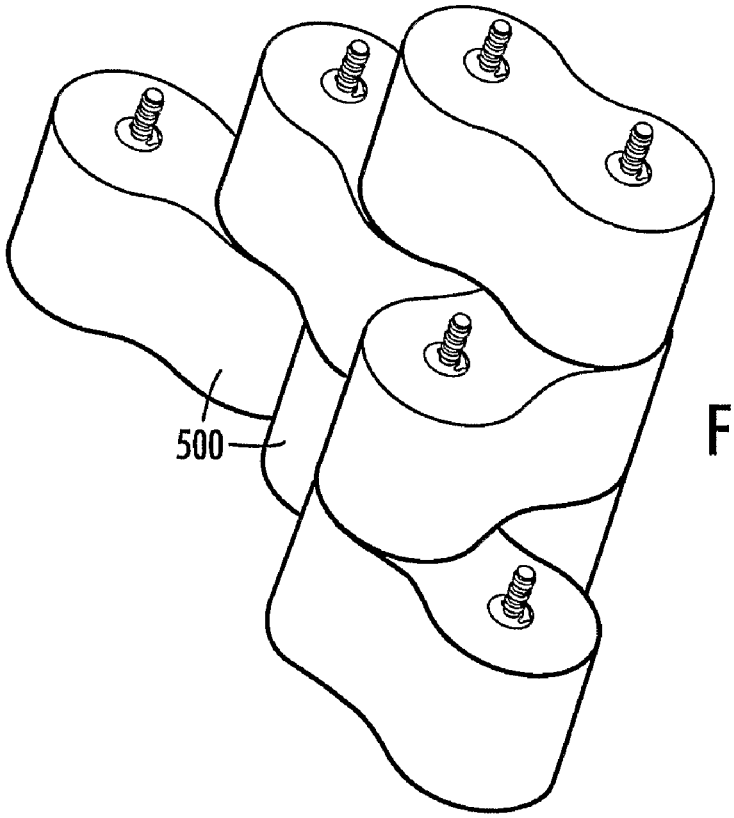
FIG. 53 is a perspective view of the wall structure of FIG. 52 in a pivoted position.

FIG. 51 illustrates a lobed modular block 500 which includes a top surface 512, a bottom surface 514, and a continuous sidewall 516. The sidewall 516 is curved into a shaped having a pinched-in "waist" 518 disposed between two cylindrical lobes 520. A generally cylindrical core passage 224 passes through the lobed modular block 500 from top to bottom at the center of each lobe 520. As shown in FIGS. 52 and 53, these lobed modular blocks 500 can be used to build up wall-like structures which can pivot about the locking rods 500 which hold them together.

Figure 54:
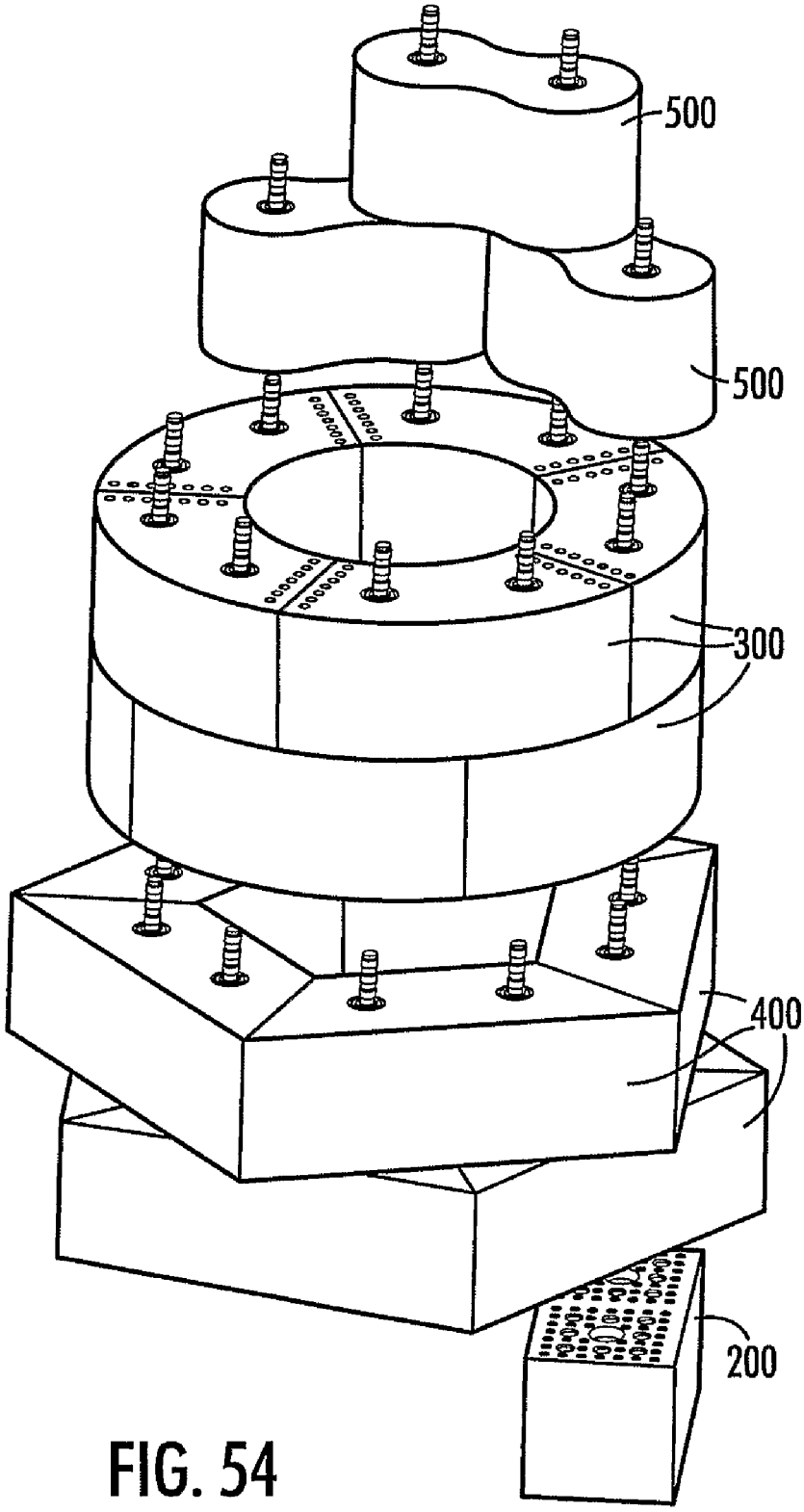
FIG. 54 is a perspective view of a structure assembled from different shapes of modular blocks.

Any of the various shapes of modular blocks described above may be attached to any other shape as long as a core passage is available. An example of a structure built up from various block shapes is shown in FIG. 54.

Figure 55:
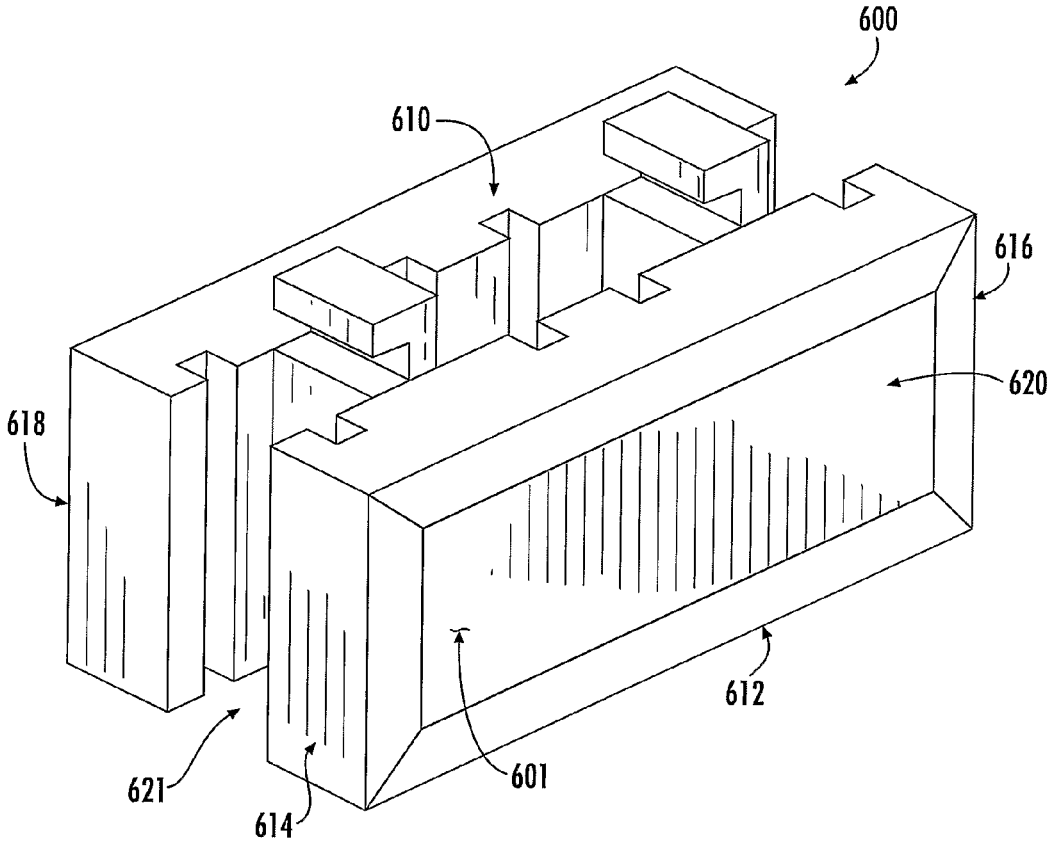
FIG. 55 is a perspective view of a modular block constructed in accordance with another alternative embodiment of the present invention.
Figure 56:
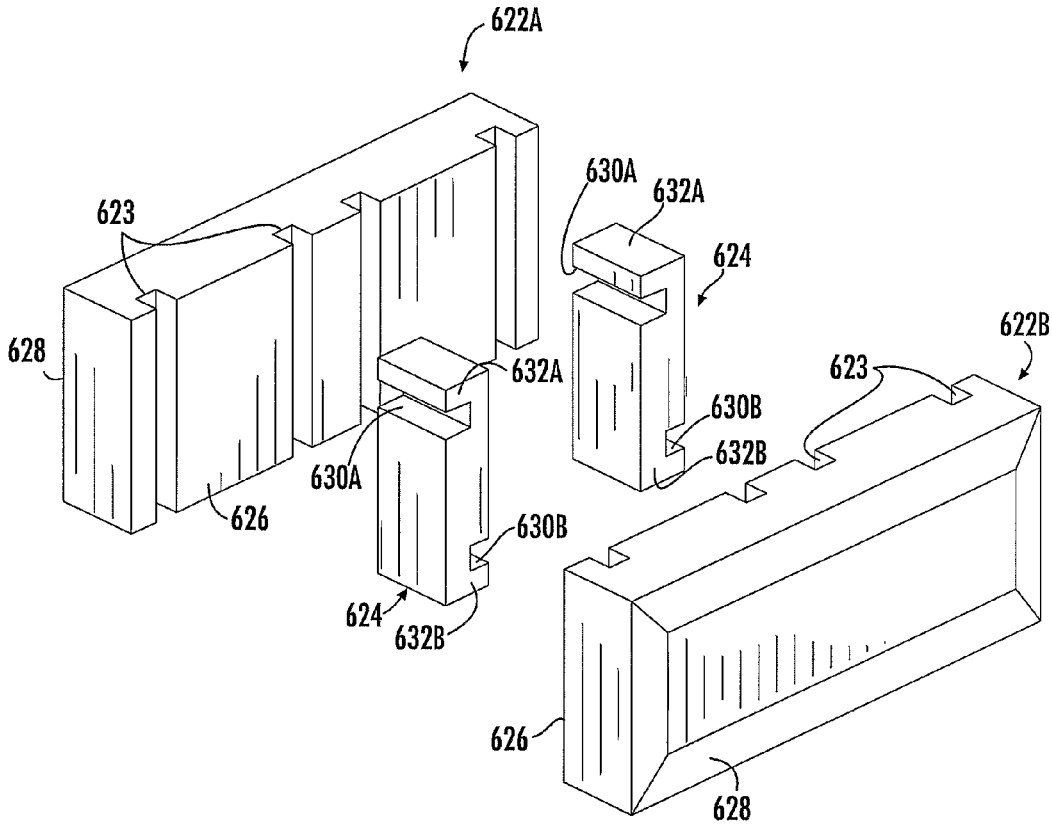
FIG. 56 is an exploded perspective view of the block shown in FIG. 55.

FIG. 55 illustrates another alternative modular block 600 constructed according to the present invention. The modular block 600 includes a top surface 610, a bottom surface 612, and front, rear, left and right sidewalls 614, 616, 618, and 620, respectively. An interior space 621 is defined along the central portion of the modular block 600. As shown more clearly in FIG. 56, the modular block 600 is built up from two side members 622A and 622B, and one or more locking lugs 624. Each of the side members 622 has an inner surface 626 and an outer surface 628. The inner surface 626 of each side member 622 is generally planar and has a plurality of key grooves 623 formed therein. Because the inner surfaces 626 are identical, the side members 622 may be produced in large quantities by providing a workpiece with a flat surface, machining long, continuous grooves in the flat surface, and then cutting the workpiece into individual side members 622.

Each of the locking lugs 624 includes upper and lower notches 630A and 630B formed near its upper and lower ends. These notches 630 are positioned and sized so as to define "L" shaped upper and lower hooks 632A and 632B, respectively. The hooks 632 are sized to engage the notches 630.

Figure 57:
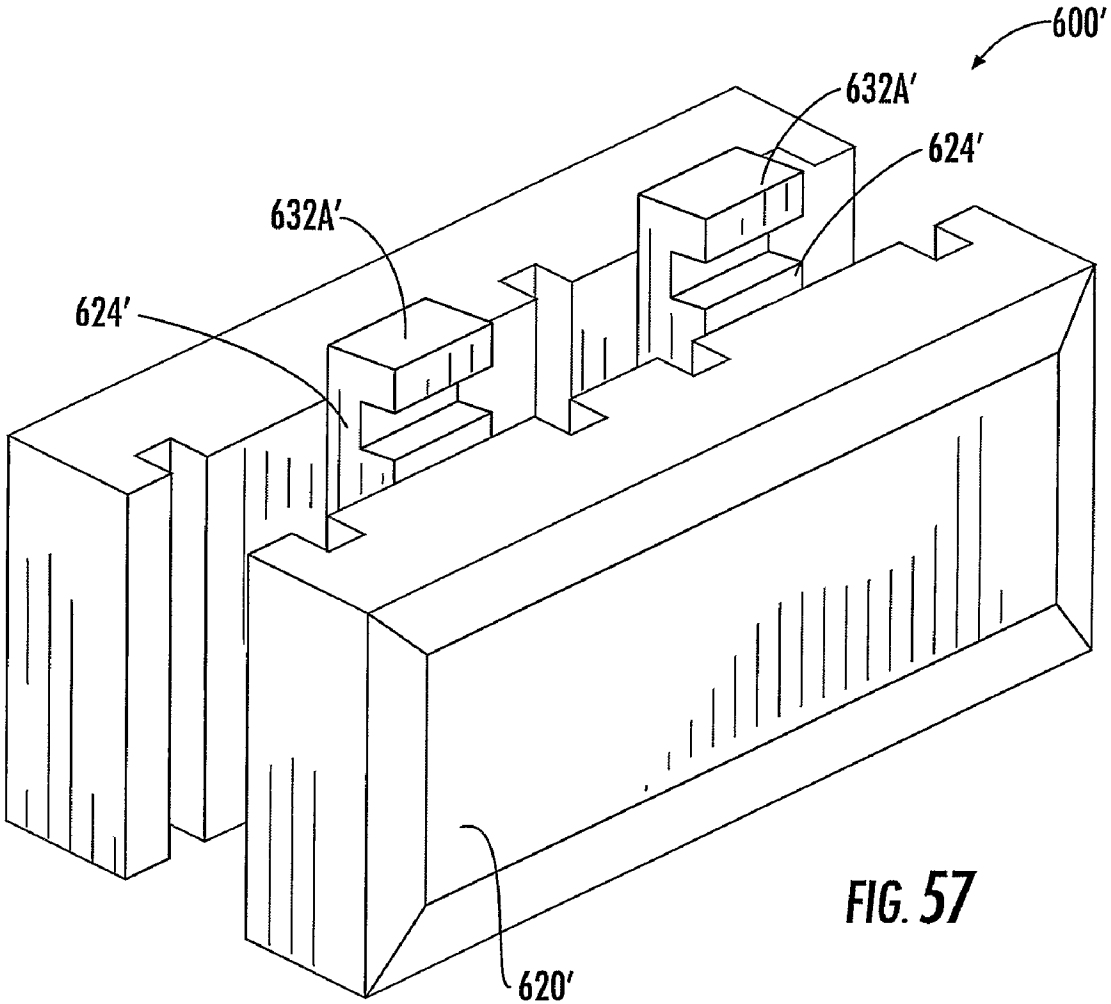
FIG. 57 is a perspective view of a variation of the block shown in FIG. 55.

Referring again to FIG. 55, the locking lugs 624 are assembled to the modular block 600 by clamping them between the side members 622A and 622B. It will be appreciated that the locking lug 624 may be assembled to the modular block 600 so that it points in any one of four directions. In FIG. 55 the upper hooks 632A of the locking lugs 624 extend towards the front endwall 614 of the modular block 600, whereas in FIG. 57, the upper hooks 632A' of the locking lugs 624' extend towards the right sidewall 620' of the modular block 600'. The components may be secured together by adhesives, welding, thermal or sonic bonding, fasteners, or any other method that will create a unitary whole. The entire modular block 600 may also be formed as an integral component, for example by casting it from a mold.

The modular block 600 and the locking lug 624 may be constructed of any material which is suited to the application for which the modular block 600 is to be used and which can be formed into the necessary dimensional features. For example, the modular block 600 may be used as a toy, a modeling element, or a light structural element, in which case it may be molded from a material such as plastic resin. The modular block 600 may also be used for heavier structural applications, in which case it may be formed from materials such as concrete, wood or engineered wood materials, pressed fiber, metals, or fiber composite materials. In the illustrated example, the modular block 600 includes an exterior fascia 601 intended to present a finished appearance. The fascia 601 may be formed as an integral part of the modular block 600, or it may be added to the exterior of the modular block 600, for example by building up a layer of mortar, joint compound, or the like, and applying an appropriate finish thereto.

Figure 58:
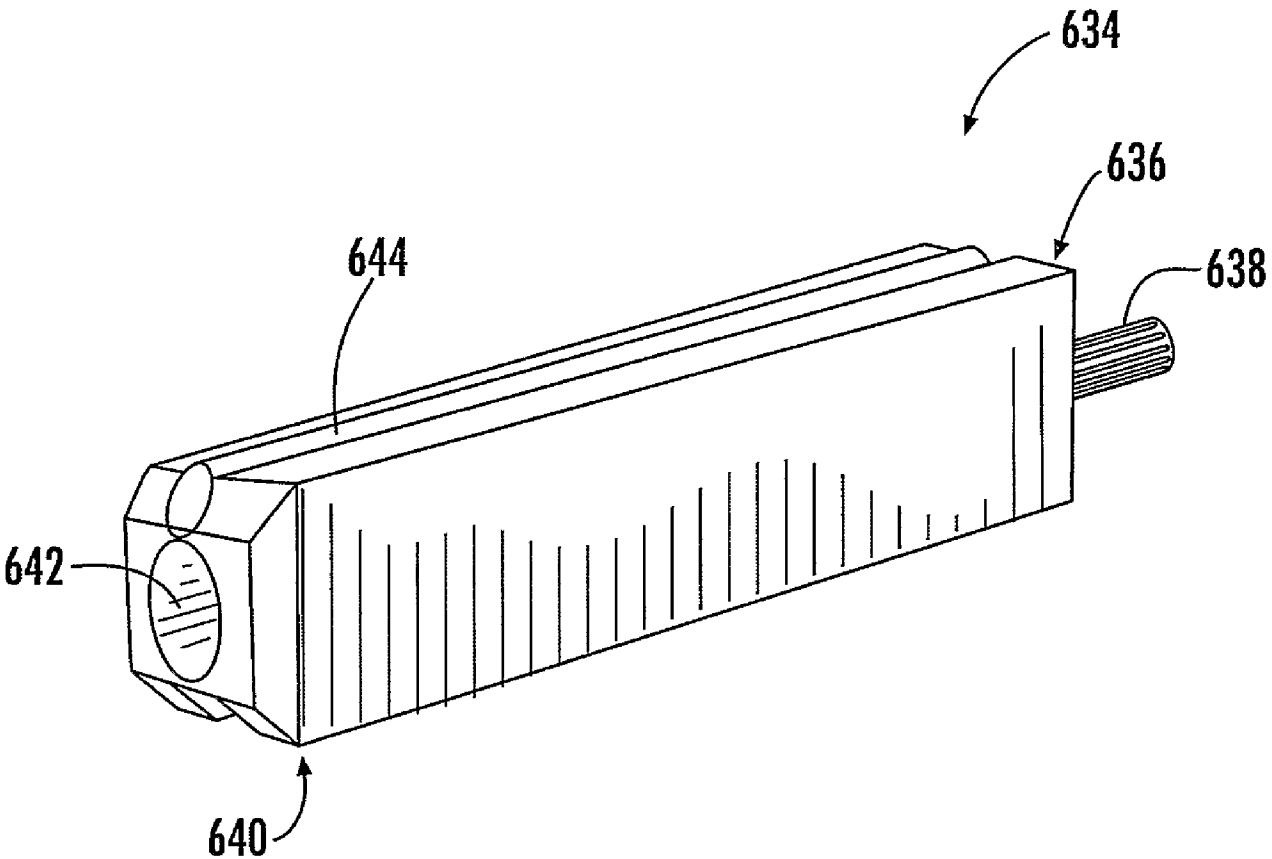
FIG. 58 is a perspective view of a key for use with the block of FIG. 55.
Figure 59:
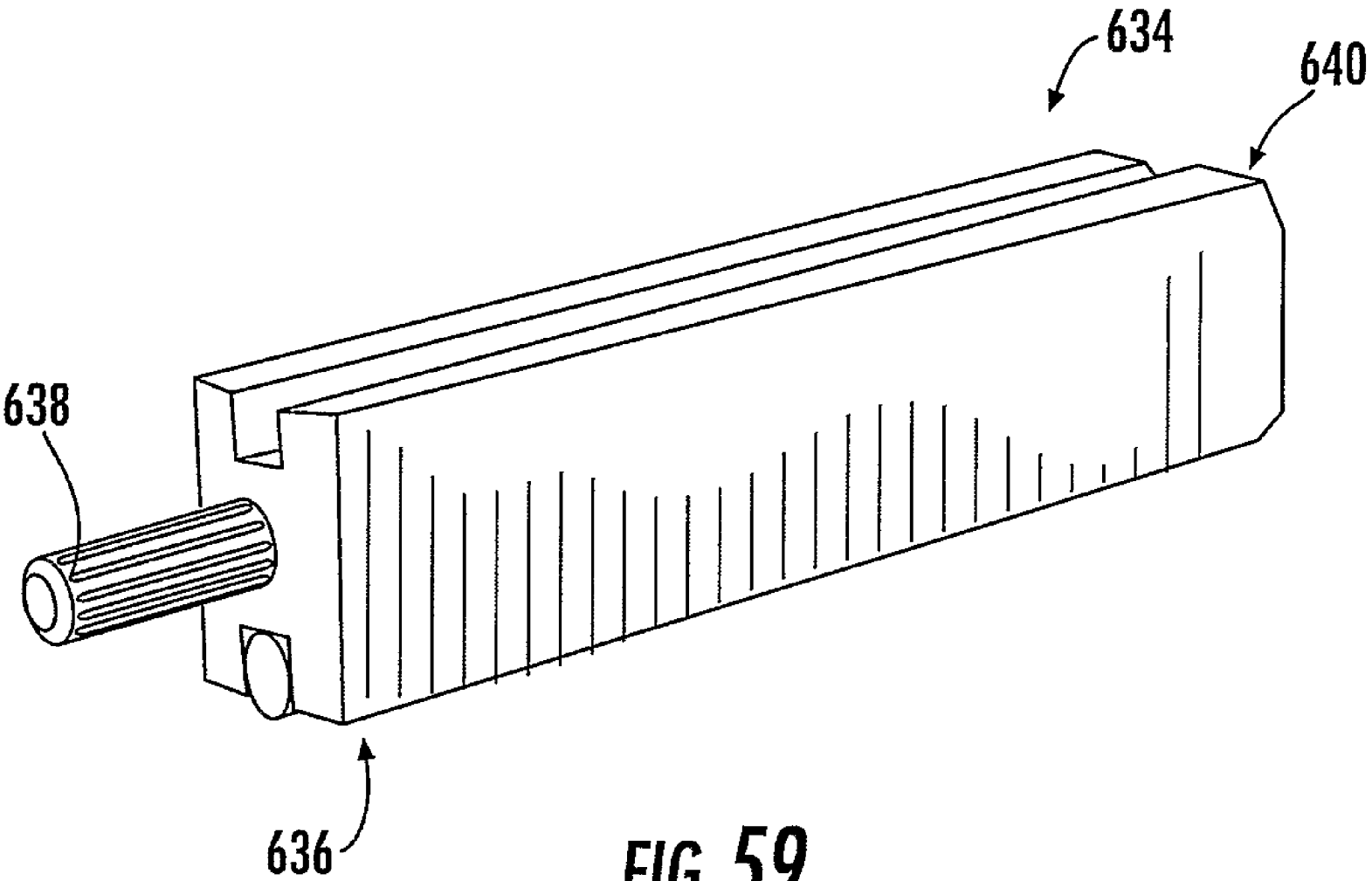
FIG. 59 is another perspective view of the key shown in FIG. 58.

FIGS. 58 and 59 illustrate a key 634 to be used with the modular blocks 600. The key 634 is an elongated member sized to fit into the interior space 621. The key 634 has an upper end 636 with an alignment pin 638 protruding therefrom, and a lower end 640 with a complementary alignment hole 642 formed therein. The key 634 also includes at least one alignment rail 644 adapted to engage the key grooves 623. In the illustrated example, the body of the key 634 is an "H" shaped cross-section, and the alignment rail 644 is formed by positioning a dowel between the uprights of the "H" section. This simplifies manufacture of the key 634.

Figure 60:
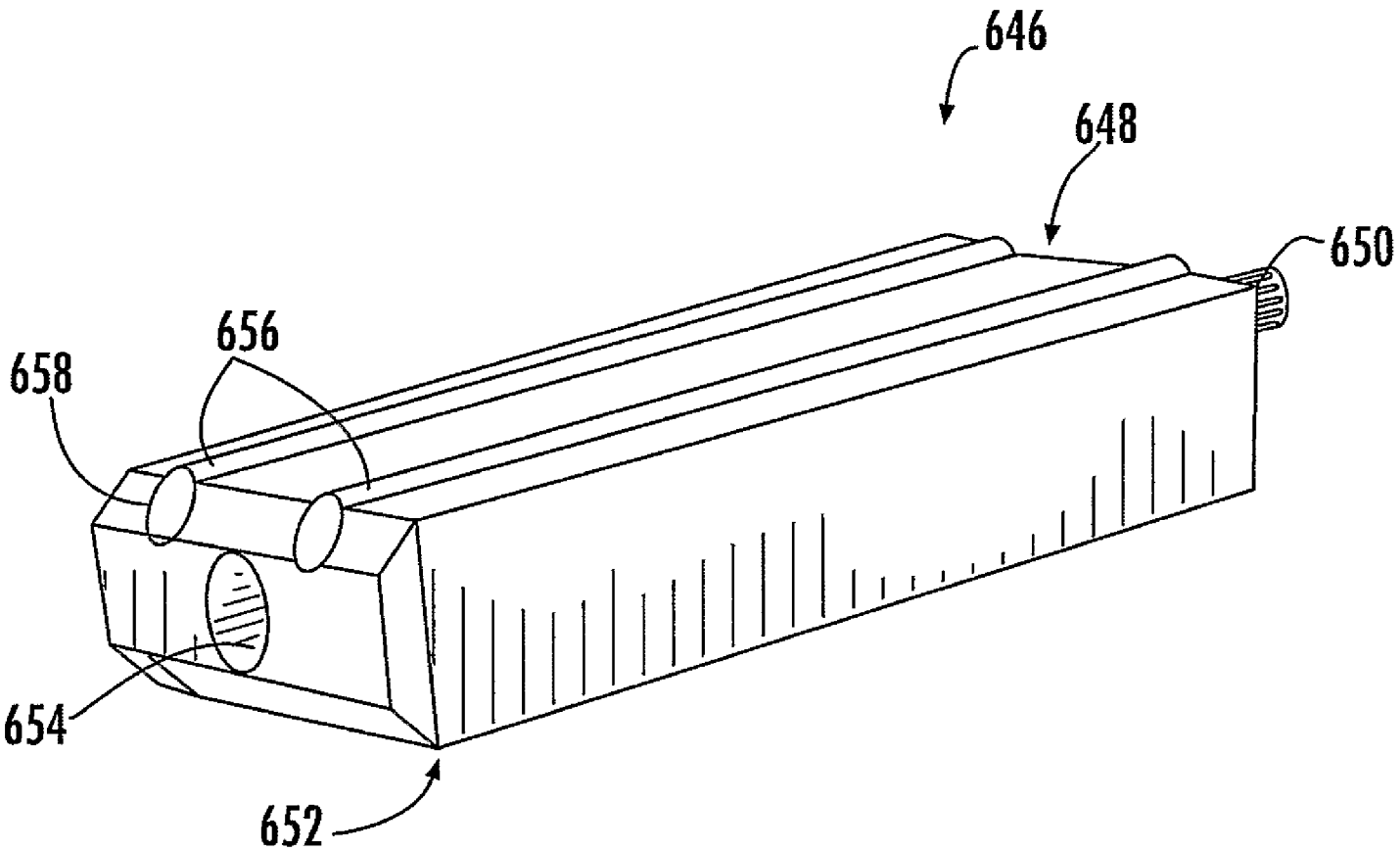
FIG. 60 is a perspective view of an alternative key for use with the block shown in FIG. 55.
Figure 61:
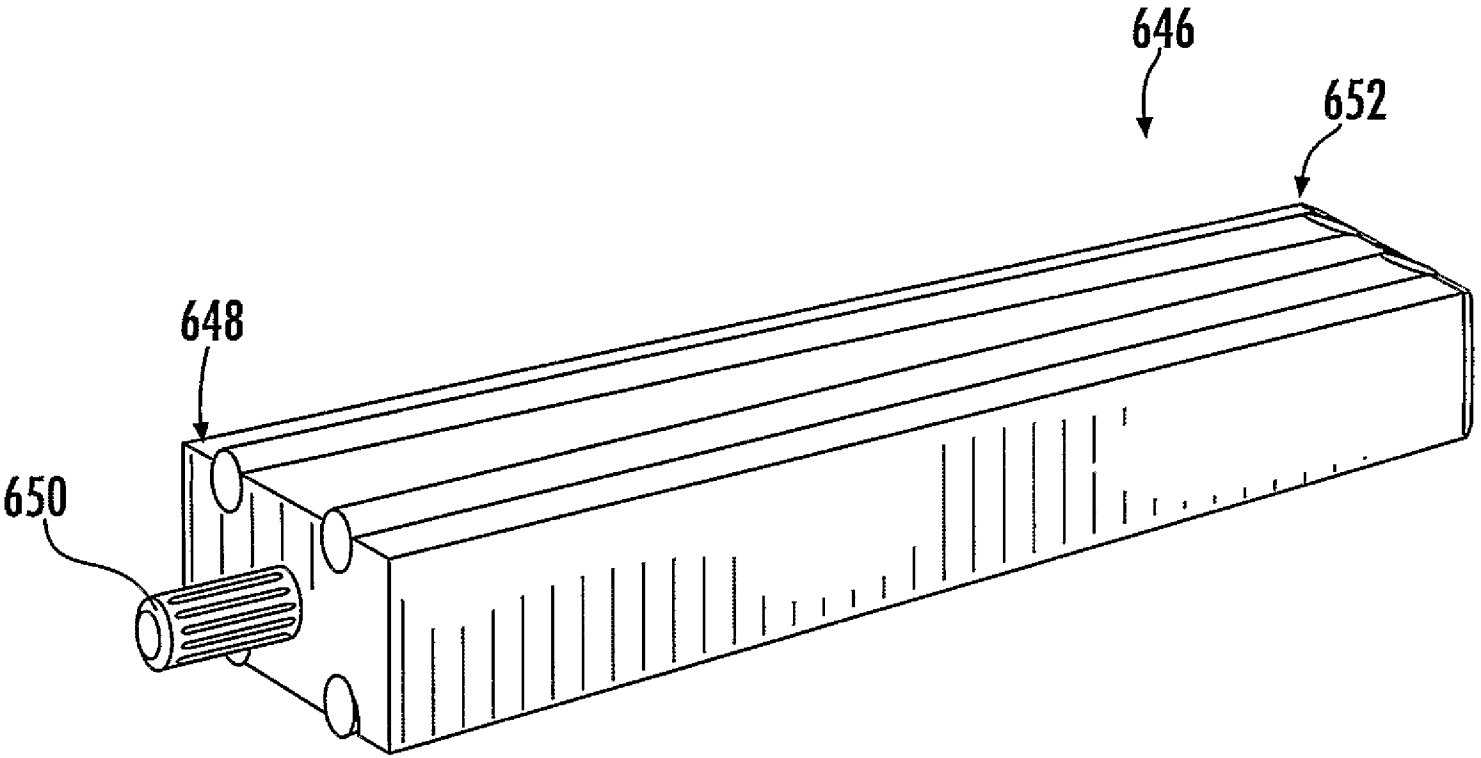
FIG. 61 is another perspective view of the key shown in FIG. 60.

FIGS. 60 and 61 illustrate an alternative key 646. The key 646 is substantially similar to the key 634 and has an upper end 648 with an alignment pin 650 protruding therefrom, and a lower end 652 with a complementary alignment hole 654 formed therein. The key 646 also includes at least one alignment rail 656 adapted to engage the key grooves 623. In the illustrated example, the body of the key 656 is generally rectangular, and the alignment rails 656 are formed by positioning dowels within slots 658 in the surface of the key 656.

Figure 62:
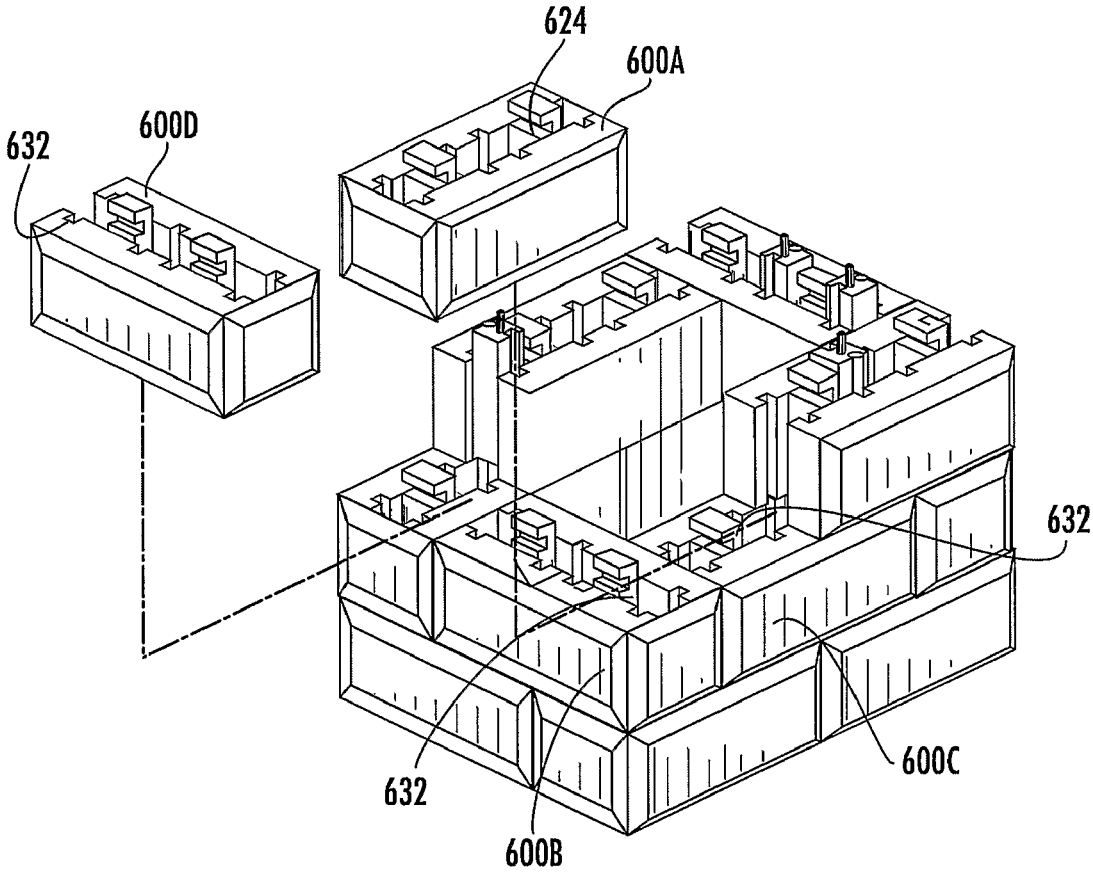
FIG. 62 is a partially exploded perspective view of a structure built up from the blocks shown in FIGS. 55 and 57.
Figure 63:
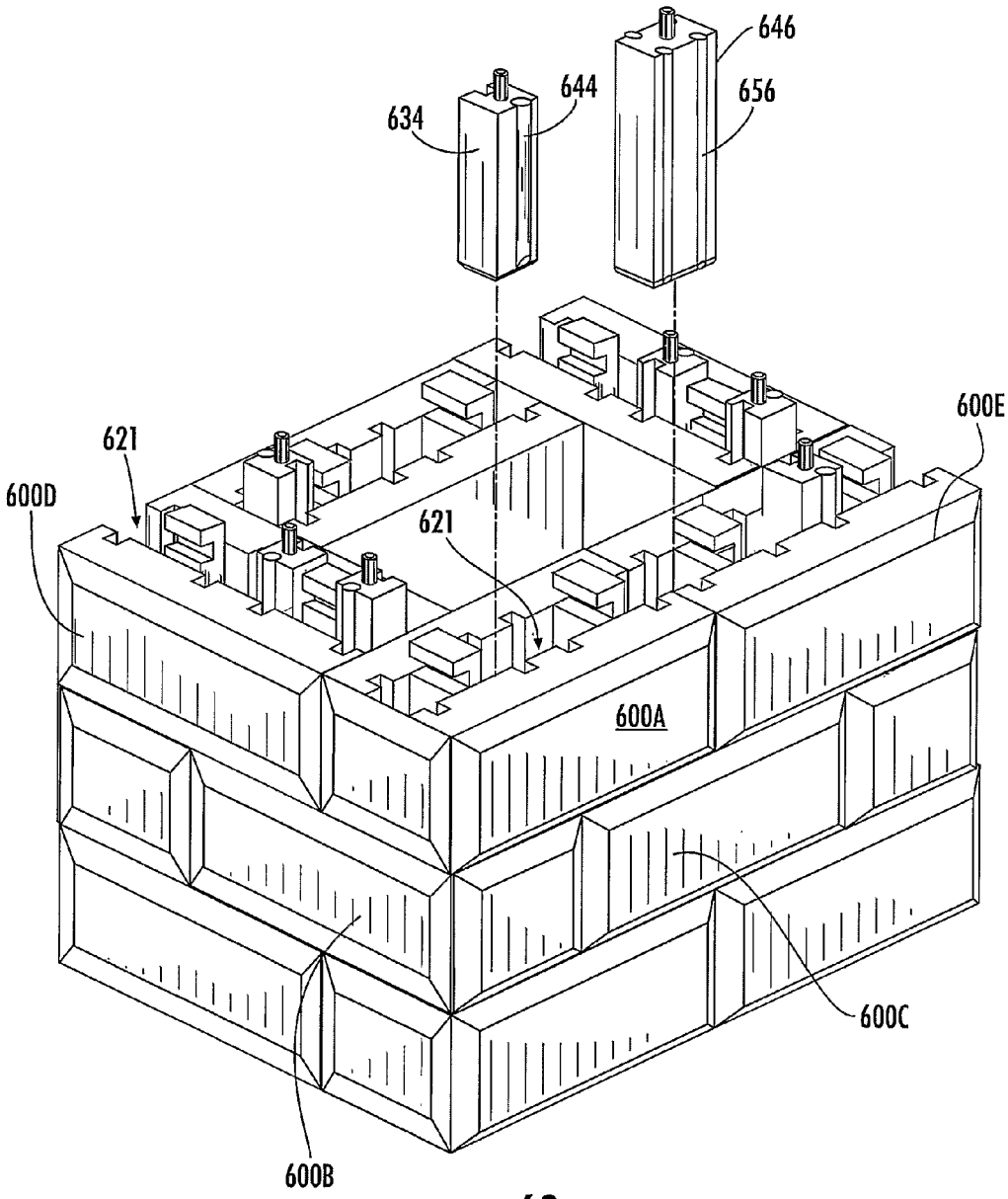
FIG. 63 is a perspective view of the structure shown in FIG. 62 showing keys being inserted therein.

FIGS. 62 and 63 illustrate how a plurality of modular blocks 600 may be assembled to form a larger structure. A first modular block identified as 600A is positioned down over the locking lugs 624 of one or more other modular blocks 600B, 600C, and then shifted laterally so that the hooks 632 of the modular blocks 600B and 600C engage the notches (not visible in FIG. 62) in the locking lugs 624 of the first modular block 600A. This prevents the modular blocks 600A, 600B, and 600C from being disconnected in a vertical direction. In creating the assembled structure, the orientation of the locking lugs 624 are preferable chosen so that the hooks 632 will all be facing in the same direction regardless of the orientation of the modular blocks 600. For example, in FIG. 62, the modular block identified as 600D has its hooks 632 facing perpendicular to its long axis.

To secure the modular blocks 600 together, one or more keys are inserted into the central spaces 621, with the alignment rails 644 engaging the key grooves 623 of both an upper modular block 600A, and the modular block 600C below it (see FIG. 63). The engagement of the key 634 prevents lateral motion of the hook 632 relative to the notches 630. A larger key 646 has multiple alignment rails 656 and therefore holds together two adjacent modular blocks 600A and 600E by engaging key grooves 623 in each of the blocks 600A and 600D. The dimensions, materials, and surface finish of the keys 634 and 646 may be selected to prevent unintended withdrawal.

The modular blocks (for example items 10, 200, 300, 400, 500, and 600) described above may be used for any type of construction which requires or would benefit from a modular characteristic. Several non-limiting examples of possible applications for theses blocks will now be set forth, without regard to a particular embodiment of the blocks themselves. Of course, the modular blocks can be used as toys or as small-scale modeling elements when produced in a proper size, say a few centimeters on a side.

When produced in larger sizes, they may be used for residential or commercial building elements such as walls, roofs, floor, retaining walls, and windows (if made from transparent or translucent material). They may also be used to construct industrial structures such as factory floors, machine tool bases and machine bodies.

The modular blocks can also be used to build marine structures such as piers, barges, underwater structures, and boat hulls.

On a smaller scale, the modular blocks may be used to build up three-dimensional circuit cards, or if made of bio-compatible materials, they may be used to form three-dimensional frames for bone or organ tissue construction. If reduced to a sufficiently small scale, they can be used for nanostructures.

The modular blocks may be formed out of armor material or projectile-resistant material, such as KEVLAR aramid fibers. These armored blocks can be used to form containers to ship military supplies. After the supplies are received at the destination, the containers can then be disassembled into modular blocks. These blocks can then be used to construct custom made protective shields for personnel or equipment. Shipping containers may also be made from more conventional construction materials and then used to ship food, water, or other supplies to disaster areas. After the supplies are received, the shipping containers may be disassembled into modular blocks and then used for low-cost buildings that can be quickly erected.

The foregoing has described a modular block and a method of construction using such modular blocks. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A modular block system, comprising:

a first block cooperatively formed by first and second side members arranged with their interior surfaces facing each other and spaced-apart to define interior space therebetween, and at least one locking lug positioned between and interconnecting the side members, the locking lug comprising a first hook at one end thereof vertically adjacent a notch and protruding beyond a top surface of the block, and a second hook at an opposing end thereof vertically adjacent a notch and positioned within the interior space, wherein the first and second hooks face in opposing directions generally perpendicular to the side members; and a second block cooperatively formed by first and second side members arranged with their interior surfaces facing each other and spaced-apart to define interior space therebetween, and at least one locking lug positioned between and interconnecting the side members, the locking lug comprising a first hook at one end thereof vertically adjacent a notch and protruding beyond a top surface of the block, and a second hook at an opposing end thereof vertically adjacent a notch and positioned within the interior space, wherein the first and second hooks face in opposing directions generally parallel to the side members;

wherein the first hook of the lug of the second block engages within the notch vertically adjacent the second hook of the lug of the first block when the first and second blocks are arranged vertically adjacent to each other; and wherein the interior surface of each of the first and second side members of the first and second blocks have at least one key groove extending continuously from the top of each block to the bottom of each block for receiving a key.

2. The modular block system of claim 1 wherein the side members and the locking lug are a single integral component.

3. The modular block system of claim 1 further comprising a key received in the interior space of the blocks having an alignment rail that engages within the at least one key groove of the blocks, the key extending between vertically adjacent arranged blocks to prevent relative lateral movement therebetween.

4. The modular block system of claim 3 wherein the key includes at least two spaced-apart alignment rails that are adapted to engage respectively within opposing key grooves of the first and second side members of the first and second blocks.

* * * * *